US011235584B2

(12) United States Patent
Hirai et al.

(10) Patent No.: US 11,235,584 B2
(45) Date of Patent: Feb. 1, 2022

(54) PRINTING APPARATUS AND PRINTING SYSTEM

(71) Applicant: Seiko Epson Corporation, Tokyo (JP)

(72) Inventors: Yasuaki Hirai, Shiojiri (JP); Ryo Oguchi, Shiojiri (JP); Shunichi Hizawa, Matsumoto (JP); Shuichi Koganehira, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/992,299

(22) Filed: Aug. 13, 2020

(65) Prior Publication Data

US 2021/0046762 A1 Feb. 18, 2021

(30) Foreign Application Priority Data

Aug. 14, 2019 (JP) ..... JP2019-148738

(51) Int. Cl.
*B41J 2/175* (2006.01)
*B41J 2/195* (2006.01)
(Continued)

(52) U.S. Cl.
CPC ..... *B41J 2/17566* (2013.01); *B41J 2/1752* (2013.01); *B41J 2/17509* (2013.01); *B41J 2/17513* (2013.01); *B41J 2/17546* (2013.01); *B41J 2/195* (2013.01); *B41J 29/13* (2013.01); *B41J 29/38* (2013.01); *B41J 29/393* (2013.01); *B41J 2002/17569* (2013.01)

(58) Field of Classification Search
CPC .... B41J 2/175; B41J 2/17509; B41J 2/17513; B41J 2/1752; B41J 2/17546; B41J 2/17566; B41J 2/195; B41J 2002/17569; B41J 29/13; B41J 29/38; B41J 29/393
See application file for complete search history.

(56) References Cited

U.S. PATENT DOCUMENTS

2002/0159777 A1* 10/2002 Nagata ..... G06Q 10/087 399/8
2009/0033974 A1 2/2009 Nishimi et al.
(Continued)

FOREIGN PATENT DOCUMENTS

JP 2001160180 A 6/2001
JP 2006221285 A 8/2006
(Continued)

*Primary Examiner* — Anh T Vo
(74) *Attorney, Agent, or Firm* — Chip Law Group

(57) ABSTRACT

A printing apparatus includes a liquid accommodation body into which liquid contained in a liquid container is configured to be poured, a printing section that performs printing by discharge of liquid supplied from the liquid accommodation body, a counting section that performs counting relating to an amount of consumption of liquid with which a liquid container was contained and counting relating to an amount of consumption of liquid per predetermined period of time, and a delivery request section that, based on a counting result yielded by the counting section, sends the server apparatus a delivery request for a liquid container by a time that is earlier by a delivery period of a liquid container than an estimated timing of completion of consumption of liquid with which a liquid container was contained.

15 Claims, 10 Drawing Sheets

(51) Int. Cl.

| | |
|---|---|
| ***B41J 29/38*** | (2006.01) |
| ***B41J 29/393*** | (2006.01) |
| ***B41J 29/13*** | (2006.01) |

(56) References Cited

U.S. PATENT DOCUMENTS

| | | | | |
|---|---|---|---|---|
| 2012/0050812 | A1* | 3/2012 | Takahashi | G06K 15/102 358/1.16 |
| 2013/0002752 | A1* | 1/2013 | Shiraiwa | B41J 2/17566 347/19 |
| 2014/0368565 | A1* | 12/2014 | Webb | B41J 2/17566 347/7 |
| 2016/0350661 | A1 | 12/2016 | Sato et al. | |
| 2019/0193407 | A1* | 6/2019 | Horade | B41J 2/1753 |

FOREIGN PATENT DOCUMENTS

| | | | |
|---|---|---|---|
| JP | 2009038702 | A | 2/2009 |
| JP | 2015201226 | A | 11/2015 |
| JP | 2016224155 | A | 12/2016 |

* cited by examiner

FIG. 8

DB

| USER | APPARATUS | APPARATUS CLASS | COMMUNICATION DESTINATION | DELIVERY DESTINATION | DELIVERY PERIOD | INK BOTTLE | INK BOTTLE CLASS | AUTHENTICATION INFORMATION | SCHEDULED DATE OF DELIVERY |
|---|---|---|---|---|---|---|---|---|---|
| USER A | APPARATUS A | APPARATUS CLASS A | COMMUNICATION DESTINATION A | DELIVERY DESTINATION A | DELIVERY PERIOD A | INK BOTTLE A1 | BOTTLE CLASS A | AUTHENTICATION INFORMATION A1 | DATE OF DELIVERY A1 |
| | | | | | | INK BOTTLE A2 | BOTTLE CLASS A | AUTHENTICATION INFORMATION A2 | DATE OF DELIVERY A2 |
| | | | | | | ... | ... | ... | ... |
| USER B | APPARATUS B | APPARATUS CLASS B | COMMUNICATION DESTINATION B | DELIVERY DESTINATION B | DELIVERY PERIOD B | INK BOTTLE B1 | BOTTLE CLASS B | AUTHENTICATION INFORMATION B1 | DATE OF DELIVERY B1 |
| | | | | | | INK BOTTLE B2 | BOTTLE CLASS B | AUTHENTICATION INFORMATION B2 | DATE OF DELIVERY B2 |
| | | | | | | ... | ... | ... | ... |
| ... | ... | ... | ... | ... | ... | ... | ... | ... | ... |

PRINTING APPARATUS AND PRINTING SYSTEM

The present application is based on, and claims priority from JP Application Serial Number 2019-148738, filed Aug. 14, 2019, the disclosure of which is hereby incorporated by reference herein in its entirety.

BACKGROUND

1. Technical Field

The present disclosure relates to a printing apparatus and a printing system that perform printing by discharging liquid such as ink onto a medium such as a sheet of paper.

2. Related Art

There has conventionally been an ink-jet printing apparatus that includes an ink accommodation body configured to hold ink and that performs printing on a medium by ejecting, through an ink ejecting head, ink supplied from the ink accommodation body. Further, such ink accommodation bodys include an ink accommodation body configured to be detachably fitted into a printing apparatus, a replacement of an ink accommodation body is made by fitting a new ink accommodation body in which ink is held.

JP-A-2016-224155 discloses, for example, such a printing apparatus that requests delivery of a new ink cartridge based on the amount of ink held in an ink cartridge and a pattern of consumption of ink. Moreover, when a new ink cartridge has been delivered, the ink cartridge is replaced by fitting, into the printing apparatus, the new ink cartridge thus delivered.

However, there is such a printing apparatus configured such that, unlike in the case of a printing apparatus with a replaceable ink cartridge, a liquid accommodation body, such as an ink accommodation body, whose ink has been consumed is replenished with liquid such as ink from a liquid container such as an ink bottle. With a printing apparatus into which such a configuration is adopted, there is a case where the liquid container per se is still contained with liquid even when the amount of liquid held in the liquid accommodation body decreases. This has made it difficult to deliver a liquid container at a suitable timing.

SUMMARY

According to an aspect of the present disclosure, there is provided a printing apparatus configured to communicate with a server apparatus, the printing apparatus including: a liquid accommodation body into which liquid contained in a liquid container is configured to be poured; a printing section that performs printing by discharge of liquid supplied from the liquid accommodation body; a counting section that performs counting relating to an amount of consumption of liquid with which a liquid container was contained and counting relating to an amount of consumption of liquid by the printing section per predetermined period of time; and a delivery request section that, based on a counting result yielded by the counting section, sends the server apparatus a delivery request for a liquid container by a time that is earlier by a delivery time of a liquid container than an estimated timing of completion of consumption of liquid with which a liquid container was contained, wherein upon authentication by the server apparatus of liquid container information relating to a new liquid container delivered, the counting section sets an initial value to a counted value relating to an amount of consumption of liquid with which the liquid container was contained.

According to an aspect of the present disclosure, there is provided a printing system including: a printing apparatus; and a server apparatus configured to communicate with the printing apparatus, wherein the printing apparatus includes a liquid accommodation body into which liquid contained in a liquid container is configured to be poured, a printing section that performs printing by discharge of liquid supplied from the liquid accommodation body, a counting section that performs counting relating to an amount of consumption of liquid with which a liquid container was contained and counting relating to an amount of consumption of liquid by the printing section per predetermined period of time, and a delivery request section that, based on a counting result yielded by the counting section, sends the server apparatus a delivery request for a liquid container by a time that is earlier by a delivery time of a liquid container than an estimated timing of completion of consumption of liquid with which a liquid container was contained, and upon authentication by the server apparatus of liquid container information relating to a new liquid container delivered, the counting section sets an initial value to a counted value relating to an amount of consumption of liquid with which the liquid container was contained.

BRIEF DESCRIPTION OF THE DRAWINGS

FIG. 8 is a schematic view showing a user information database stored in a storage section of a server apparatus according to the embodiment.

DESCRIPTION OF EXEMPLARY EMBODIMENTS

In the following, a printing apparatus and a printing system according to an embodiment are described with reference to the drawings.

Figure 1:
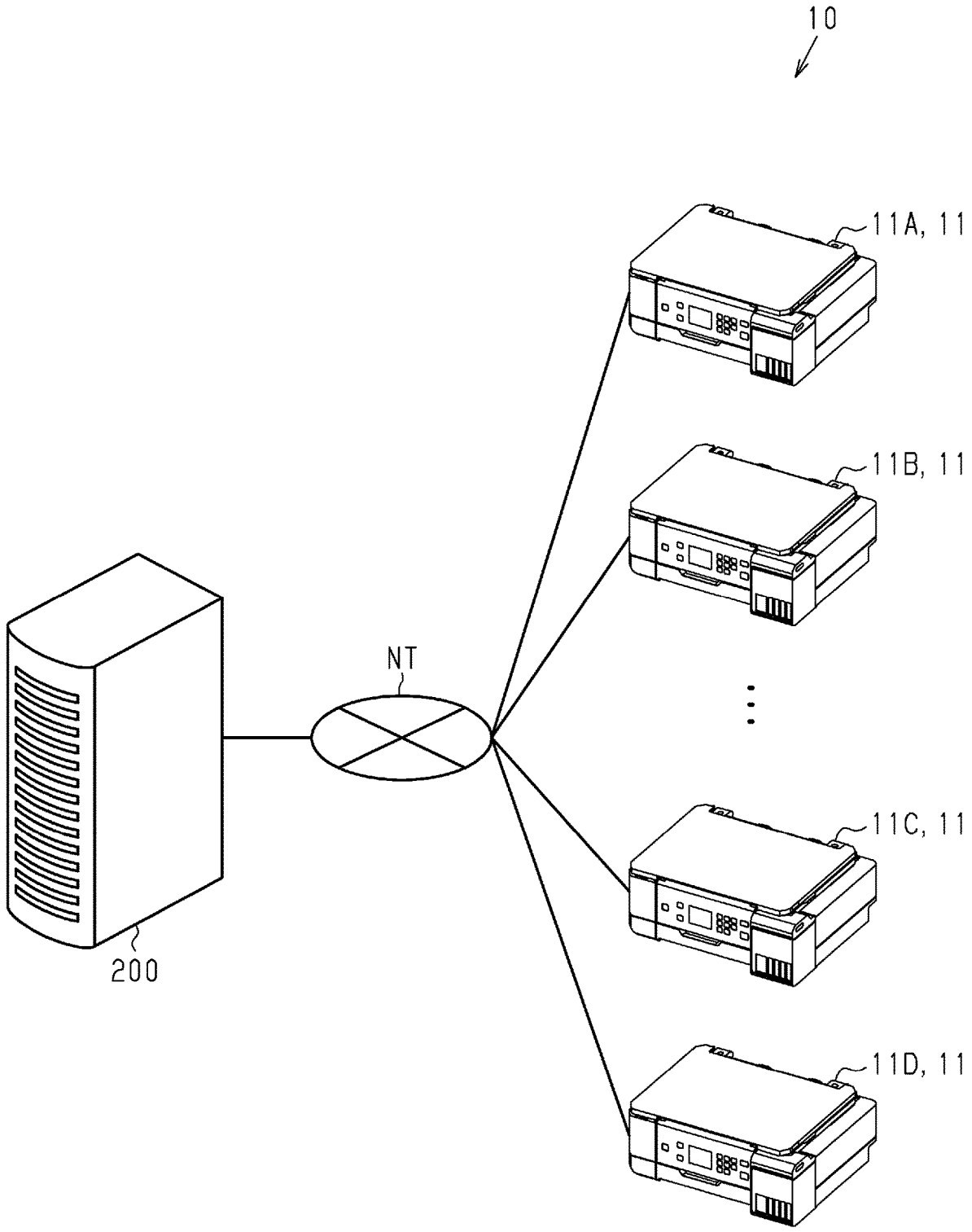
FIG. 1 is a schematic view of a printing system according to an embodiment.

As shown in FIG. 1, a printing system 10 includes a plurality of printing apparatuses 11 (in FIG. 1, printing apparatuses 11A to 11D) configured to perform printing on a medium such as a sheet of paper by discharging liquid such as ink onto the medium and a server apparatus 200 that provides each of the plurality of printing apparatuses 11 with information. The server apparatus 200 is communicably connected to one or more printing apparatuses 11 via a network NT.

Figure 2:
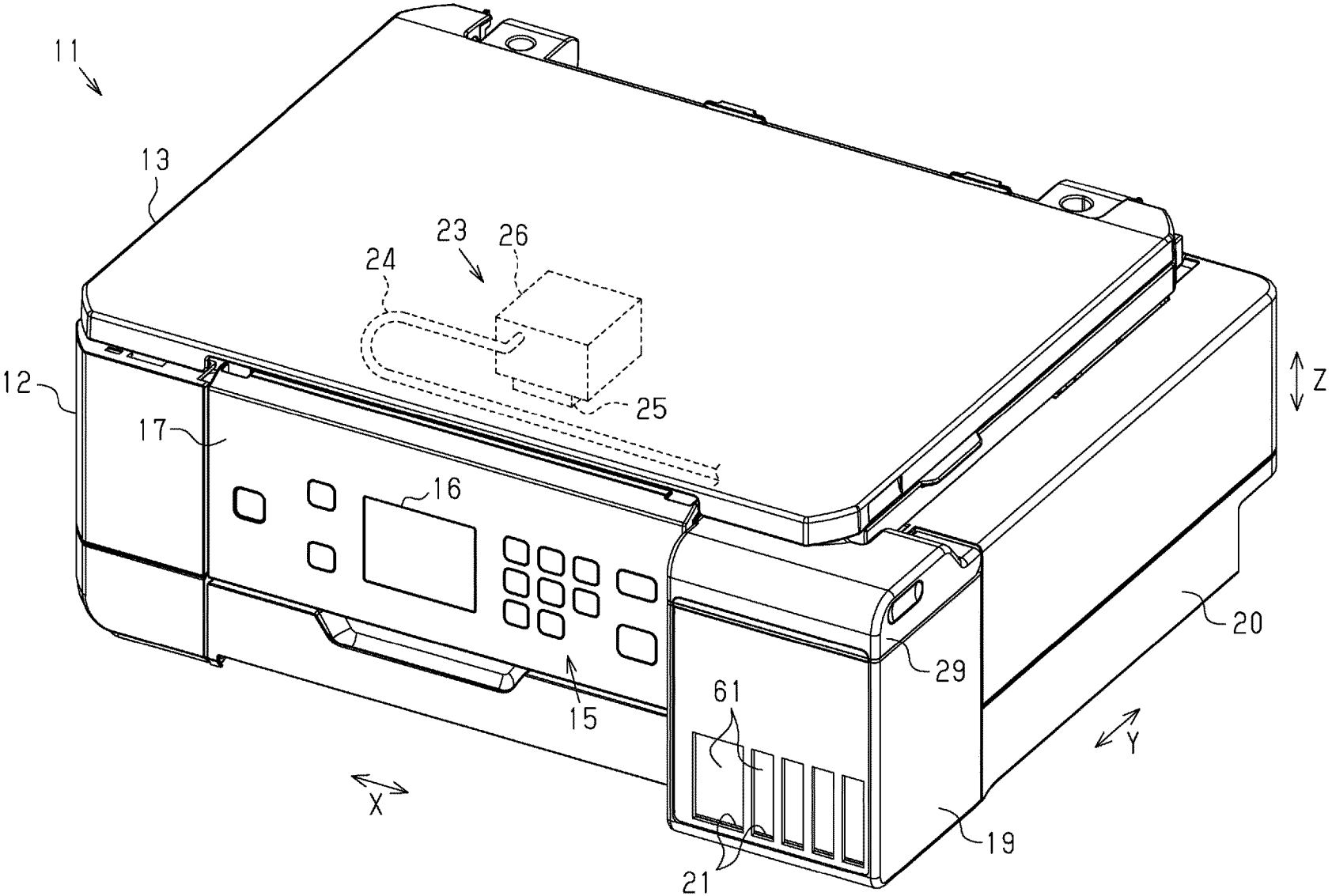
FIG. 2 is a perspective view of a printing apparatus including a printing section according to the embodiment.

As shown in FIG. 2, a printing apparatus 11 includes a printing section 12 that performs printing on a sheet of paper and an image reading section 13 that is disposed on top of the printing section 12 to cover an upper side of the printing section 12 and that reads an image as image data, and forms a substantially cuboidal shape as a whole.

In the present embodiment, a direction of gravitational force is referred to as "downward direction", and a direction opposite to the direction of gravitational force is referred to as "upward direction". Moreover, in FIG. 2, assuming that the printing apparatus 11 is placed on a horizontal plane, a direction parallel to the direction of gravitational force is illustrated as a vertical direction Z, and directions parallel to the horizontal plane are illustrated as a width direction X and a depth direction Y. That is, the width direction X, the depth direction Y, and the vertical direction Z cross (or preferably, are orthogonal to) one another. Further, one end side in the depth direction Y may be referred to as "front" or "front side", and the other end side opposite to the one end side may be referred to as "rear" or "rear side". One end side in the width direction X as seen from the front may be referred to as "right", and the other end side may be referred to as "left".

The printing apparatus 11 has provided at the front thereof an operation panel 17 including an operation section 15 such as buttons for carrying out various types of operation of the printing apparatus 11 and a display section 16 that displays information on the printing apparatus 11 or other information. Furthermore, at the right of the operation panel 17, there is provided a holder unit 19 holding at least one or more (in the present embodiment, five) ink accommodation bodys 18 (see FIG. 4). The ink accommodation bodys 18, which are examples of a liquid accommodation body, are provided inside a housing 20 of the printing apparatus 11, and the housing 20 is provided with at least one or more (in the present embodiment, five) window portions 21 corresponding to each separate ink accommodation body 18.

Further, the housing 20 houses a discharge section 23 that discharges ink onto a medium (not illustrated) and a supply section 24, having a tube or other components, for supplying the discharge section 23 with ink held in the ink accommodation bodys 18. The discharge section 23 includes an ink ejecting head 25 that ejects ink out of a nozzle (not illustrated) and a carriage 26 configured to reciprocate along the width direction X (scanning direction) while retaining the ink ejecting head 25. Moreover, the discharge section 23 prints on a medium by ejecting ink toward the medium from the ink ejecting head 25 while the ink ejecting head 25 is moving.

In this way, the housing 20 is provided with the operation panel 17 and houses the ink accommodation bodys 18 (see FIG. 4), the supply section 24, the ink ejecting head 25, the carriage 26, or other components. Although, in the present embodiment, a plurality of the supply sections 24 are individually provided in correspondence with the ink accommodation bodys 18, FIG. 2 illustrates only one supply section 24 for the purpose of simplified illustration.

Figure 3:
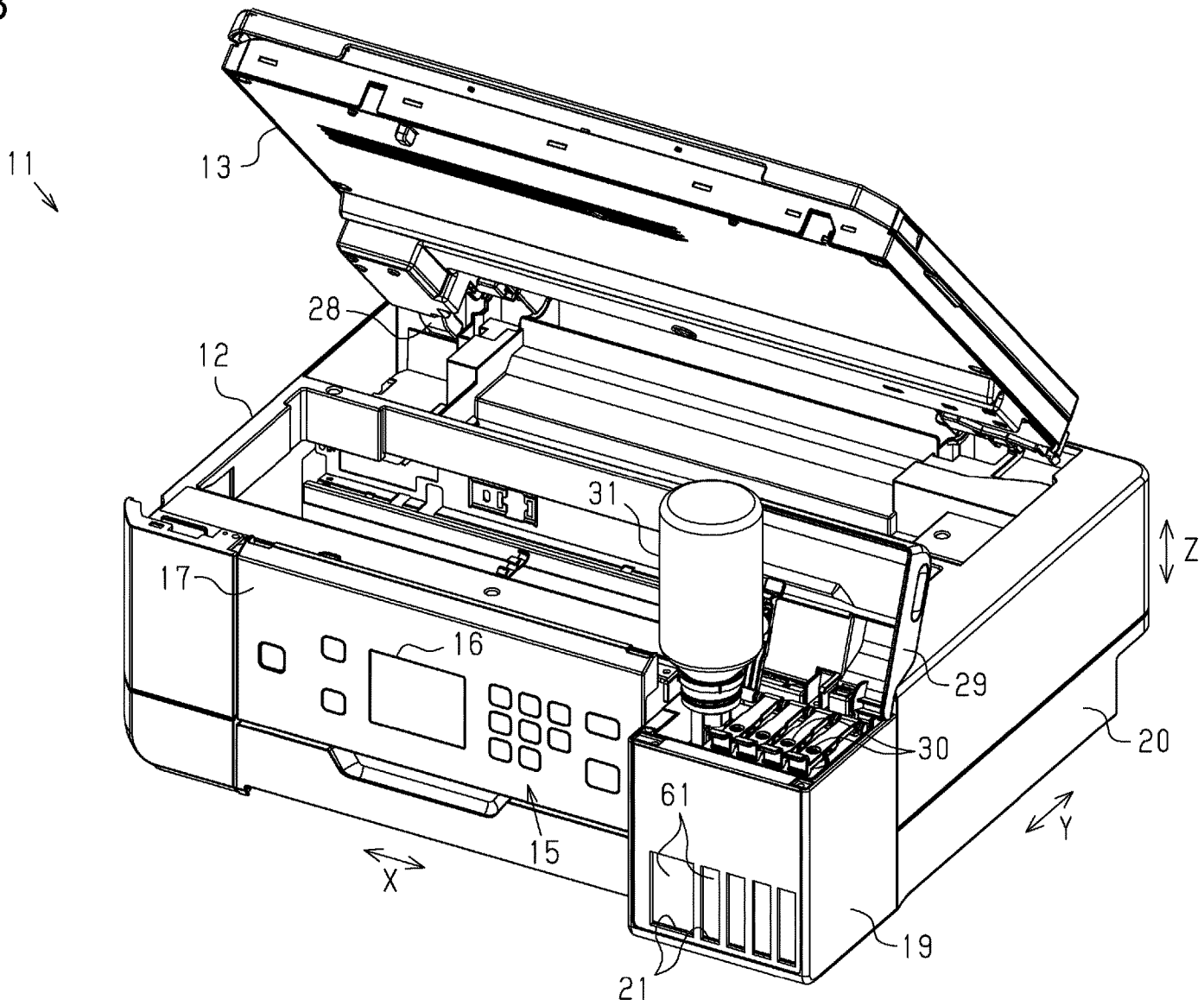
FIG. 3 is a perspective view of a printing apparatus whose ink accommodation body is being replenished with ink.

As shown in FIG. 3, the image reading section 13 is attached via a rolling mechanism 28, such as a hinge, provided at the rear. The image reading section 13 is configured to open and close with respect to the printing section 12 and rotates between a closed position shown in FIG. 2 and an open position shown in FIG. 3. Moreover, placing the image reading section 13 into the open position renders openable and closable a cover 29 of the holder unit 19 and caps 30 attached to the ink accommodation bodys 18 (see FIG. 4). When an ink accommodation body 18 is replenished with ink, the image reading section 13, the cover 29, and the cap 30 are placed into the open position as shown in FIG. 3, and an ink bottle 31, which is an example of a liquid container, contained with replenishing ink is coupled to the ink accommodation body 18.

Next, a configuration in which to attach an ink accommodation body 18 to the printing section 12 and the placement of the ink accommodation bodys 18 are described.

Figure 4:
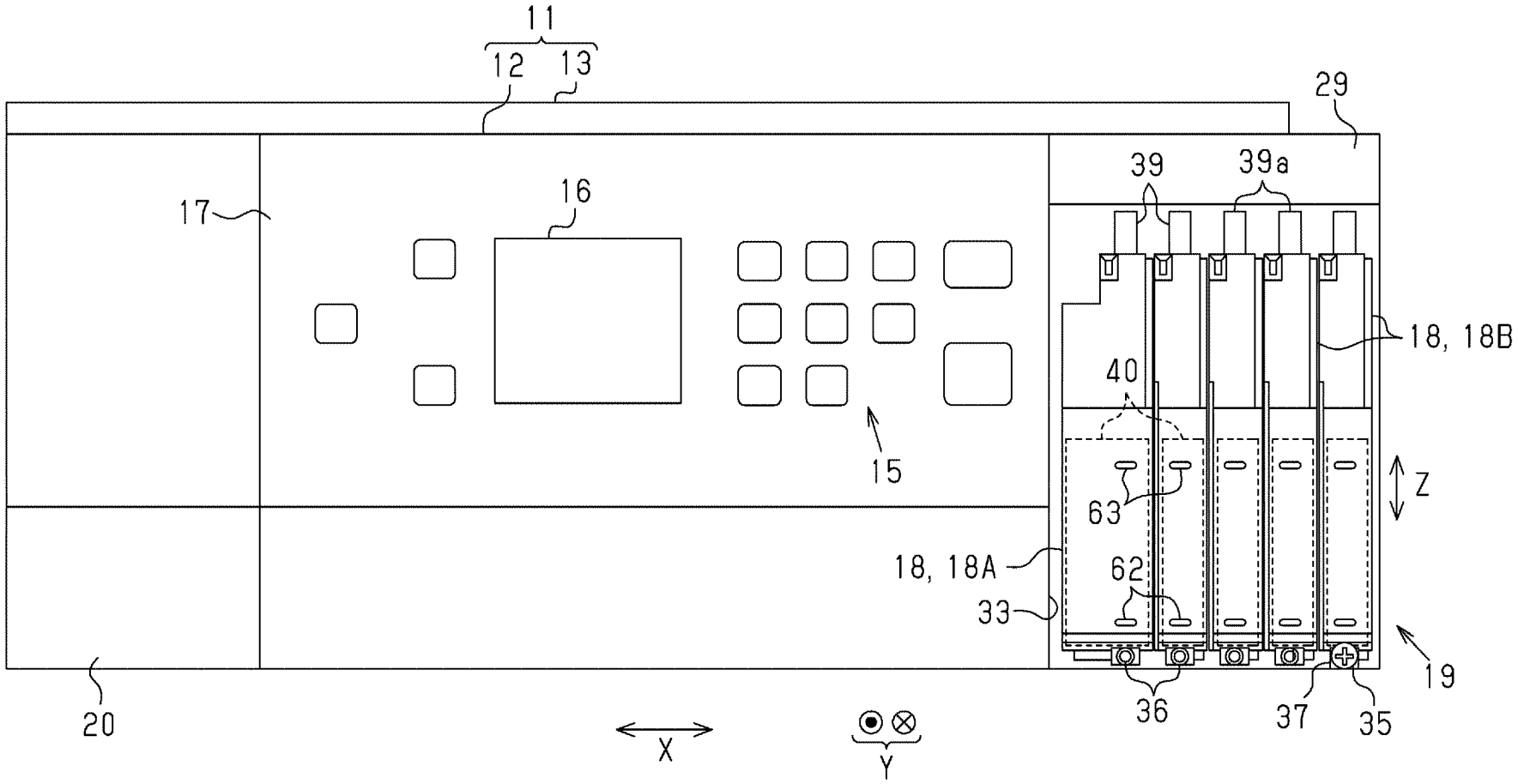
FIG. 4 is a front view of a printing apparatus with omission of illustration of a housing of a tank unit.

As shown in FIG. 4, the holder unit 19 includes an attaching section 33 configured to attach the ink accommodation bodys 18. Attached to the attaching section 33 is an arrangement in the width direction X of first and second ink accommodation bodys 18A and 18B configured to hold different amounts of ink. Each ink accommodation body 18 holds a different type of ink (e.g. a color such as cyan, magenta, yellow, or black or a colorant such as a pigment or dye).

In the present embodiment, there are provided one first ink accommodation body 18A, used as a black ink accommodation body, that holds a large amount of ink is provided beside the operation panel 17, and four second ink accommodation bodys 18B, used as color ink accommodation bodys, that hold smaller amounts of ink than the first ink accommodation body 18A. The plurality of second ink accommodation bodys 18B are identical in configuration to one another, and a description of components that are common to the first ink accommodation body 18A and the second ink accommodation bodys 18B is omitted by giving the components the same signs.

The ink accommodation bodys 18 are provided with lugs (not illustrated) that engage with the attaching section 33 and threaded portions 36 to which attaching screws 35 are screwed. Further, the attaching section 33 is provided with locking portions 37 that lock the attaching screws 35.

The ink accommodation bodys 18 are firmly fixed to the attaching section 33 by the attaching screws 35 being screwed to the threaded portions 36 while being locked by the locking portions 37 with the lugs engaged in the attaching section 33. In this way, the ink accommodation bodys 18 are placed so that at least parts thereof are located at such a height as to be lined up with the operation panel 17 in the width direction X.

By being firmly fixed to the attaching section 33, the ink accommodation bodys 18 are brought into a usage state in which the printing section 12 is usable and an pouring state in which ink is poured into ink holding chambers 40 through ink pouring flow passages 39 to which ink bottles 31 are coupled and through which ink is poured. In this pouring state, the ink pouring flow passages 39 have their first ends 39*a* located above the operation section 15 and the display section 16. In this way, the ink pouring flow passages 39, through which ink contained in the ink bottles 31 is poured into the ink holding chambers 40, are equivalent to examples of a pouring flow passage, and the ink holding chambers 40, which hold ink, are equivalent to examples of a liquid holding chamber.

Next, a configuration of the first ink accommodation body 18A, which serves as an example of the ink accommodation bodys 18, is described.

Figure 5:
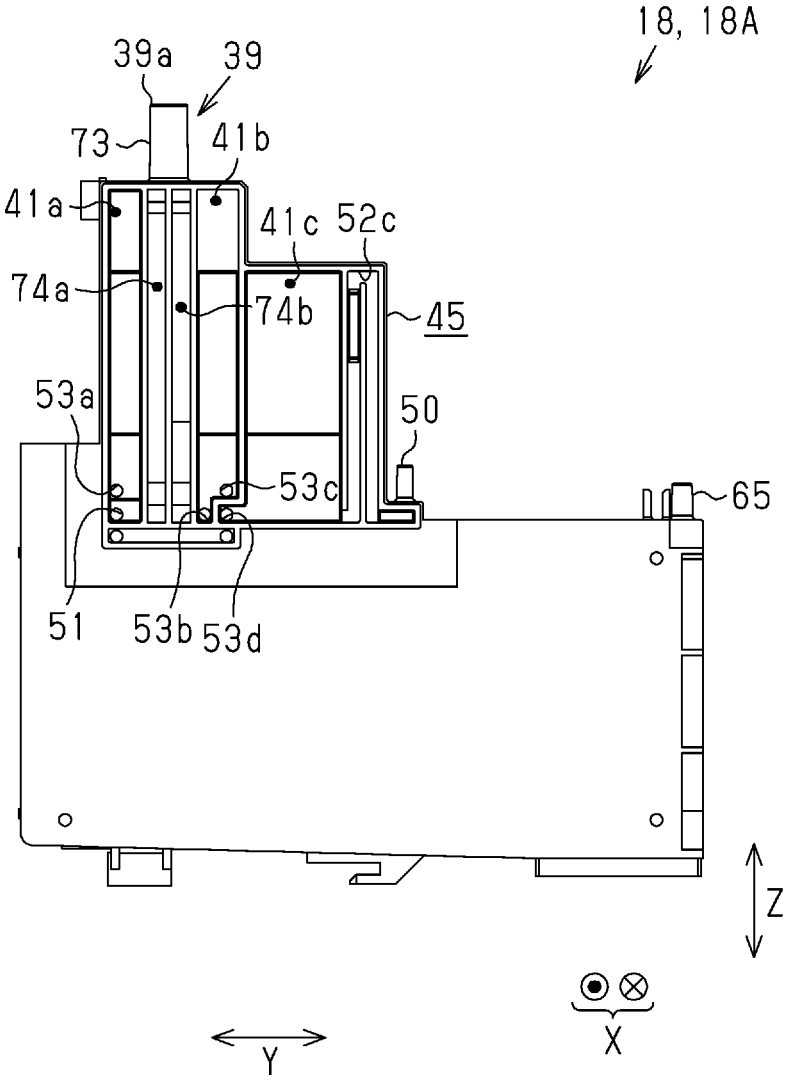
FIG. 5 is a right side view of a first ink accommodation body.
Figure 6:
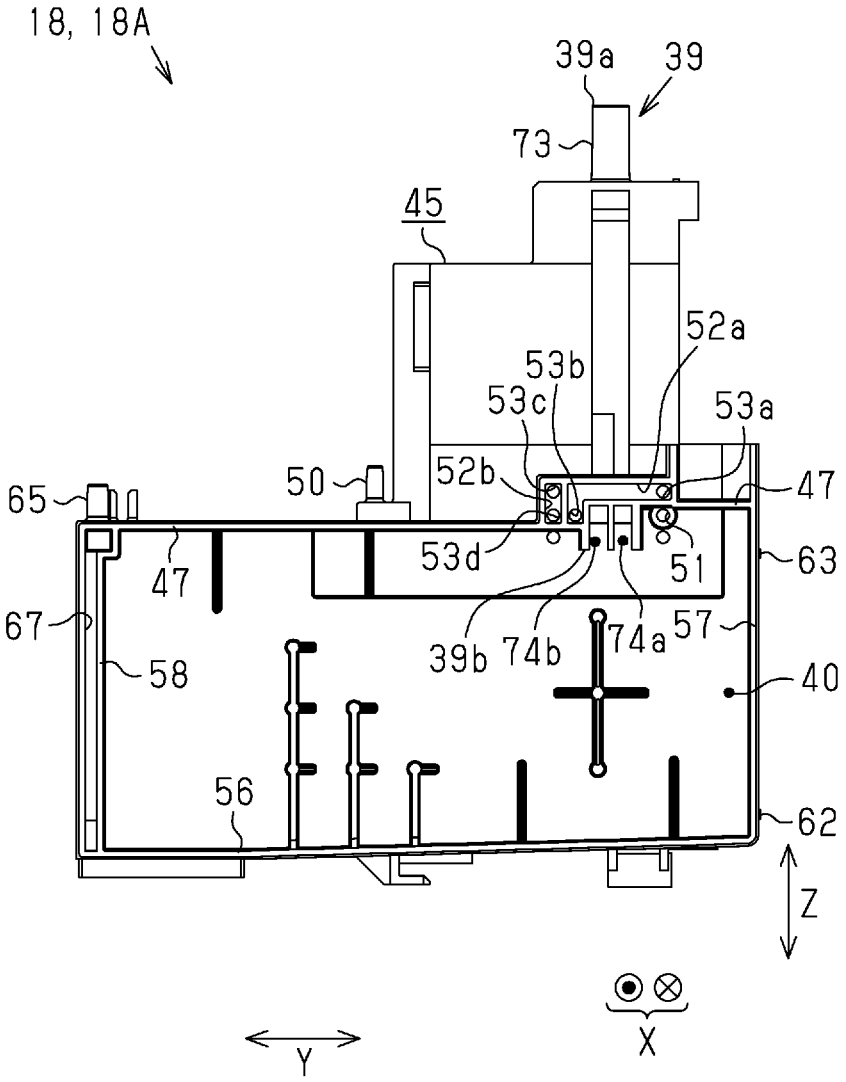
FIG. 6 is a left side view of the first ink accommodation body.

As shown in FIGS. 5 and 6, the first ink accommodation body 18A includes an ink holding chamber 40 configured to hold ink to be supplied to the ink ejecting head 25 and at least one or more (in the present embodiment, three) buffer chambers 41*a* to 41*c* provided above the ink holding chamber 40. Furthermore, the first ink accommodation body 18A includes an atmosphere communicating portion 50 that leads the third buffer chamber 41*c* to the atmosphere.

The first buffer chamber 41*a* and the second buffer chamber 41*b* are provided at at least either side (in the present embodiment, both sides) of the ink pouring flow passage 39 in the depth direction Y so as to extend along the ink pouring flow passage 39. The first buffer chamber 41*a* is provided at the front side of the ink pouring flow passage 39, and the second buffer chamber 41*b* and the third buffer chamber 41*c* are provided at the rear side of the ink pouring flow passage 39. Further, the ink pouring flow passage 39 couples a first end 39*a* opening toward the outside of the ink holding chamber 40 to a second end 39*b* opening toward the inside of the ink holding chamber 40, and is configured to pour ink into the ink holding chamber 40.

The first ink accommodation body 18A includes a communicating portion 51 that leads a lower end of the first buffer chamber 41*a* to an upper end of the ink holding chamber 40 and coupling portions 52*a* to 52*c* that couple the buffer chambers 41*a* to 41*c* to one another so that the buffer chambers 41*a* to 41*c* communicate with one another.

When the first ink accommodation body 18A is in a usage state, the communicating portion 51 communicates with the ink holding chamber 40 in a higher position than the second end 39*b* of the ink pouring flow passage 39. The first coupling portion 52*a* couples the first buffer chamber 41*a* to the second buffer chamber 41*b*. Further, the second coupling portion 52*b* couples the second buffer chamber 41*b* to the third buffer chamber 41*c*. Moreover, the third coupling portion 52*c*, formed along a finely winding serpentine course, couples the third buffer chamber 41*c* to the atmosphere communicating portion 50.

Specifically, the first coupling portion 52*a* couples a first through-hole 53*a* to a second through-hole 53*b*. The first through-hole 53*a* is formed in a lower part of the first buffer chamber 41*a* so as to be located above the communicating portion 51, and the second through-hole 53*b* is formed at a lower end of the second buffer chamber 41*b*. Further, the second coupling portion 52*b* couples a third through-hole 53*c* to a fourth through-hole 53*d*. The third through-hole 53*c* is formed in a lower part of the second buffer chamber 41*b* so as to be located above the second through-hole 53*b*, and the fourth through-hole 53*d* is formed at a lower end of the third buffer chamber 41*c*.

Accordingly, the ink holding chamber 40 communicates with the atmosphere communicating portion 50 via the communicating portion 51, the first buffer chamber 41*a*, the first coupling portion 52*a*, the second buffer chamber 41*b*, the second coupling portion 52*b*, the third buffer chamber 41*c*, and the third coupling portion 52*c*.

The first ink accommodation body 18A is constituted by a holder case 45 made of a transparent or semitransparent resin and configured such that the liquid level of ink held in the ink holding chamber 40 is viewable from outside. Moreover, a region of a front wall 57 that corresponds to the window portion 21 (see FIG. 2) of the housing 20 functions as a viewing surface 61 through which ink inside the ink holding chamber 40 is viewable from outside. The viewing surface 61 is provided with a lower limit indicator 62 that serves as a benchmark for replenishing the ink holding chamber 40 with ink and an upper limit indicator 63 that serves as a benchmark for an upper limit of the amount of ink with which the ink holding chamber 40 is replenished. The viewing surface 61 is provided so as to extend along the vertical direction Z when the first ink accommodation body 18A is in a usage state.

Alternatively, the first ink accommodation body 18A does not need to be provided with the upper limit indicator 63. For example, in the housing 20 of the printing section 12, the window portion 21 that faces the viewing surface 61 may be formed as a light-transmitting wall by a transparent or semitransparent member so as to be provided with an upper limit indicator 63. Alternatively, it is also possible not to provide an upper limit indicator 63. That is, ink can be poured without checking the upper limit indicator 63, as the pouring of the ink is automatically stopped when the ink has been poured up to the second end 39*b* during the pouring of the ink.

A top wall 47 is provided with an ink outlet portion 65 to which the supply section 24 (see FIG. 2) is coupled and through which ink flows out. Further, a bottom wall 56 is formed at a slant so as to become higher toward the front wall 57 in the depth direction Y. A filter attaching portion 66 is formed as a recess in the bottom wall 56 so as to be located at a lower side of the slant and beside a rear wall 58. The first ink accommodation body 18A includes an ink outlet path 67 coupled to the ink outlet portion 65 via a filter (not illustrated) of the filter attaching portion 66. In the filter attaching portion 66, the filter is provided, for example, by thermal welding. Moreover, when ink is consumed by the ink ejecting head 25, ink held in the ink holding chamber 40 is supplied to the discharge section 23 via the ink outlet path 67, the ink outlet portion 65, and the supply section 24 after having passed through the filter of the filter attaching portion 66.

The ink pouring flow passage 39 has its second end 39*b* located in an upper space in the ink holding chamber 40 and formed so as to project downward from the top wall 47, which defines the ink holding chamber 40. That is, when the first ink accommodation body 18A is in a usage state, the first end 39*a* of the ink pouring flow passage 39 is located above (in the present embodiment, vertically above) the second end 39*b*. Moreover, the first end 39*a* is located above the top wall 47, and the second end 39*b* is located below the top wall 47. Further, the upper space in the ink holding chamber 40 is a space in the ink holding chamber 40 that is higher than the middle of the ink holding chamber 40.

The ink pouring flow passage 39 has a tubular portion 73 provided so as to extend along the vertical direction Z, and has at least one or more (in the present embodiment, a plurality of) ink flow passages, namely a first ink flow passage 74*a* and a second ink flow passage 74*b*, that couple the first end 39*a*, which is a leading end (upper end) of the tubular portion 73, to the second end 39*b*.

The first ink flow passage 74*a* and the second ink flow passage 74*b* have their second ends 39*b* located at equal heights in the ink holding chamber 40. Moreover, the ink pouring flow passage 39 has its second end 39*b* located in such a position as to correspond to the upper limit indicator 63 in the vertical direction Z. Specifically, the second end 39*b* is located at the same height as the upper limit indicator 63 in the vertical direction Z or near the upper limit indicator 63.

Figure 7:
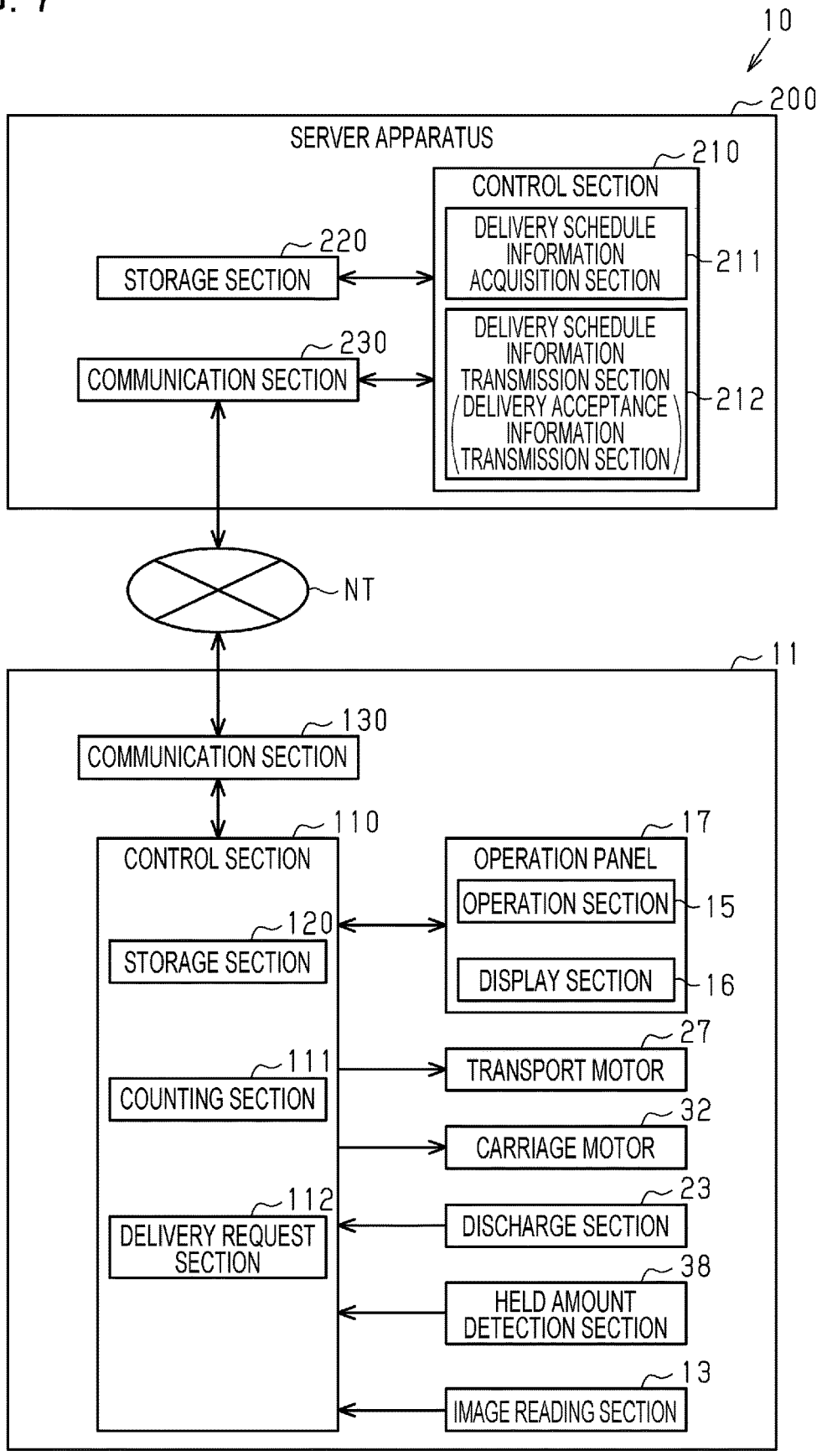
FIG. 7 is a block diagram showing an electrical configuration of the printing system according to the embodiment.

Next, an electrical configuration of a printing system 10 is described with reference to FIG. 7. The printing system 10 is described here assuming that one printing apparatus 11 is communicably connected to the server apparatus 200 via the network NT.

The printing apparatus 11 includes a control section 110. To the control section 110, a communication section 130, an operation panel 17, a transport motor 27, a carriage motor 32, a discharge section 23, and an image reading section 13 are electrically coupled. The operation panel 17 includes an operation section 15 and a display section 16. When the display section 16 is a touch panel, the operation section 15 may be constituted by an operational functional portion of the touch panel. The printing apparatus 11 may include a held amount detection section 38 shown in FIG. 7. The held amount detection section 38 detects the held amount of ink held in each ink accommodation body 18. The held amount detection section 38 is for example a level sensor that detects the held amount of ink held in each ink accommodation body 18, and outputs a detection signal representing a detection result to the control section 110.

The control section 110 includes a CPU, an ASIC (application-specific integrated circuit), and a storage section 120 (memory) composed of a RAM, a nonvolatile memory, or other memories. The CPU exercises various types of control including control of the printing apparatus 11 by executing a control program stored in the storage section 120. The storage section 120 has stored therein the control program, which is responsible for various types of control in the printing apparatus 11, and reference data to which the control program refers. The storage section 120 has stored therein various types of information for controlling the printing apparatus 11 through the control section 110. The communication section 130 is communicably connected to the server apparatus 200 via the network NT.

Further, the control section 110 includes a counting section 111 and a delivery request section 112 as functional sections that function by executing the control program. The counting section 111 counts the amount of consumption of ink discharged by the discharge section 23, the amount of consumption of ink per predetermined period of time, and the amount of consumption of ink with which an ink bottle 31 that has been delivered was contained. The counting section 111 has various types of counter assigned to the storage section 120. The counting section 111 includes an ink counter that counts the amount of consumption of ink from a timing at which authentication information relating to a new ink bottle 31 has been authenticated by the server apparatus 200 and an ink bottle counter that counts the amount of consumption of ink contained in a new ink bottle 31 whose use starts from a timing at which the ink bottle 31 has been authenticated. In the present example, the ink bottle counter counts, as the amount of consumption of an ink bottle 31, an amount remaining in the ink bottle 31 that is equivalent to a value obtained by subtracting the amount of consumption of ink from a contained amount with which the ink bottle 31 was contained. Note here that the amount remaining in the ink bottle 31 as counted by the ink bottle counter is the sum of the amount of ink remaining in the ink bottle 31 and the amount of ink remaining in an ink accommodation body 18 into which ink is poured out of the ink bottle 31. That is, the ink bottle counter counts the total amount of ink remaining in the ink bottle 31 and the ink accommodation body 18.

Further, the counter 111 sequentially stores the value of the ink counter each time a monitoring timing for every predetermined time comes and, for example, stores the values of a plurality of amounts of consumption of ink every predetermined time up to the predetermined period of time ago. When a monitoring timing for every predetermined time comes, the control section 110 acquires, from the difference between the amount of consumption of ink this time as counted by the ink counter and the amount of consumption of ink the predetermined period of time ago, the amount of consumption of ink consumed during the most recent predetermined period of time. Such a configuration may be set up that the amount of consumption of ink consumed during the predetermined period of time is updated every predetermined time. When a monitoring timing for every predetermined time comes, the control section 110 may acquire the amount of consumption of ink consumed during the most recent predetermined period of time by reading it out from the storage unit 120.

The delivery request section 112 sends the server apparatus 200 a delivery request for an ink bottle 31. In particular, based on a counting result yielded by the counting section 111, the delivery request section 112 estimates a timing of completion of consumption of ink with which an ink bottle 31 was contained and sends the server apparatus 200 a delivery request for an ink bottle 31 by a time that is earlier than the timing thus estimated by a delivery period required to deliver an ink bottle 31.

Note here that the timing of completion of consumption of ink with which an ink bottle 31 was contained refers to a timing at which ink with which an ink bottle 31 that has been delivered was contained is not held in the ink bottle 31 or the ink accommodation body 18 and has been completely consumed by being discharged by the discharge section 23. The timing of completion of consumption of ink is a timing at which the total amount of ink remaining in the ink bottle 31 and the ink accommodation body 18 becomes "0", which indicates an ink end.

When ink is consumed at an ink consumption rate estimated from the amount of consumption of ink consumed during the most recent predetermined period of time, a delivery request timing is a timing that is earlier by the delivery period than a timing at which the total amount of ink remaining the ink bottle 31 and the ink accommodation body 18 is estimated to reach an ink end (remaining ink amount "0").

For example, when the delivery request timing is a timing that is earlier by the delivery period than a timing at which the total amount of ink remaining the ink bottle 31 and the ink accommodation body 18 is estimated to reach "0", which indicates an ink end, there is in no small part a possibility that a new ink bottle 31 might be delivered to a user after an ink end has been reached on the very day of delivery.

For the surefire avoidance of such a situation, it is more preferable that a delivery request be made at a timing that is earlier by the delivery period than a timing at which the total amount of ink remaining in the ink bottle 31 and the ink accommodation body 18 is estimated to reach an ink remaining amount to which a predetermined margin of value has been added than at a timing at which the total amount of ink remaining in the ink bottle 31 and the ink accommodation body 18 is estimated to reach an ink end. The predetermined margin of value may be set at any value; however, if the predetermined margin of value is too large, there will occur a situation where the timing of delivery of an ink bottle 31 is too early. For this reason, it is preferable that the predetermined margin of value be set, for example, at a predetermined value falling within a range of greater than "0", which indicates an ink end, to not greater than a near end. Setting such a predetermined margin of value makes it possible to more surely deliver a new ink bottle 31 to a user before the timing of completion of consumption of ink with which an ink bottle 31 was contained.

Since a delivery request is made at a timing based on an estimated value and a new ink bottle 31 is surely delivered before an ink end, there is a case where ink remains in the ink accommodation body 18 at the time of first use of the new ink bottle 31 when the new ink bottle 31 has been authenticated. For this reason, upon authentication of a new ink bottle 31, the control section 10 acquires, based on a detection signal from the held amount detection section 38, a remaining ink amount held in the ink accommodation body 18 corresponding to the ink bottle 31 authenticated at that time. The control section 110 sets, as the initial value of the ink bottle counter, a corrected initial value obtained by adding, to an initial value equivalent to the amount contained in the ink bottle 31, a value equivalent to the remaining amount of ink remaining in the ink accommodation body 18.

Further, in the case of a configuration including no held amount detection section 38, the control section 110 may switch to a mode in which at the time of first use of a new ink bottle 31 when the new ink bottle 31 has been authenticated, information on the remaining amount of ink remaining in the ink accommodation body 18 at that time is inputted by operating the operation section 15. A user reads the amount of ink remaining in the ink accommodation body 18 from a scale on the window portion 21 and inputs the remaining ink amount information thus read by operating the operation section 15. The control section 110 sets, as the initial value of the ink bottle counter, a value obtained by adding together an initial value equivalent to the amount contained in the ink bottle 31 and the amount of ink remaining in the ink accommodation body 18 as indicated by the remaining ink amount information inputted from the operation section 15. In this way, upon authentication of a new ink bottle 31, the control section 110 sets, as the initial value of the ink bottle counter, a corrected value obtained by adding, to the amount contained in the ink bottle 31, the amount of ink remaining in the ink accommodation body 18 at that time. That is, the control section 110 is configured to correct the initial value of the ink bottle counter according to the amount of ink remaining in the ink accommodation body 18 at the time of authentication of a new ink bottle 31.

The transport motor 27 is a drive source that transports a medium in accordance with a control signal from the control section 110. The carriage motor 32 is a drive source that drives the carriage 26 in accordance with a control signal from the control section 110. When the printing apparatus 11 is a line printer, the printing apparatus 11 is electrically configured such that the carriage motor 32 is removed from FIG. 6. The discharge section 23 discharges ink onto a medium in accordance with a control signal from the control section 110. The image reading section 13 reads an image in accordance with a control signal from the control section 110 and outputs the image data thus read to the control section 110.

The server apparatus 200 includes a control section 210, a storage section 220, and a communication section 230. The control section 210 includes a CPU. The CPU exercises various types of control relating to the server apparatus 200 by executing a control program. The storage section 220 has stored therein the control program, which is responsible for various types of control in the server apparatus 200, and reference data to which the control program refers. The communication section 230 is communicably connected to another apparatus such as the printing apparatus 11 via the network NT.

Further, the control section 210 includes a delivery schedule information acquisition section 211 and a delivery schedule information transmission section 212 as functional sections that function by executing the control program. The delivery schedule information acquisition section 211 acquires delivery schedule information on a new ink bottle 31 upon acceptance of a delivery request. The delivery schedule information transmission section 212 transmits delivery schedule information acquired by the delivery schedule information acquisition section 211 to the printing apparatus 11. In particular, the delivery schedule information transmission section 212 can also be said to be a delivery acceptance information transmission section that, in order to transmit delivery schedule information to the printing apparatus 11 upon acceptance of a delivery request from the printing apparatus 11, transmits delivery acceptance information on the acceptance of the delivery request to the printing apparatus 11.

In the present embodiment, the printing system 10 is adopted into a system (so-called "subscription") that charges for a period of utilization of the printing system 10 regardless of the amount of ink consumed. In such a system, it is necessary to deliver an ink bottle 31 so that a printing apparatus 11 does not run out of ink held in an ink accommodation body 18. Meanwhile, too early a timing of delivery of an ink bottle 31 undesirably leads to an increase of unused ink bottles. To address this problem, the present embodiment adopts a printing system 10 that, by a printing apparatus 11 managing the remaining amount of ink with which an ink bottle 31 was contained and the amount of consumption of ink per predetermined period of time, determines such a suitable delivery request timing that a new ink bottle 31 gets to a user at a suitable timing before the amount remaining in the ink bottle 31 reaches an ink end.

In such a printing system 10, the server apparatus 200 manages, as a user information database, information relating to a plurality of printing apparatuses 11 constituting the printing system 10. Moreover, the server apparatus 200 manages delivery information relating to the delivery of an ink bottle 31 in response to a delivery request from a printing apparatus 11 and exercises authentication control in response to an authentication request from a printing apparatus 11.

Meanwhile, a printing apparatus 11 exercises control of counting of the amount of consumption of ink with which an ink bottle 31 was contained and the amount of consumption of ink per predetermined period of time, makes a delivery request for an ink bottle 31, and exercises printing control based on an authentication result.

In the present embodiment, the server apparatus 200 has the user information database stored in the storage section 220. The user information database is a group of items of information for managing information relating to ink that is used by a printing apparatus 11.

As shown in FIG. 8, a user information database DB associates one or more items of apparatus identification information with one item of user identification information. User identification information is user-specific identification information configured to identify a user. Apparatus identification information is printing-apparatus-11-specific identification information configured to identify a printing apparatus 11.

The user information database DB associates apparatus class information, apparatus communication information, delivery destination information, and delivery period information with one item of apparatus identification information. Apparatus class information is information configured to identify the class (model) of a printing apparatus 11. Apparatus communication information is information for communicating with a printing apparatus 11. Delivery destination information is information indicating a place in which a printing apparatus 11 was installed, and is information for delivering an ink bottle 31. Delivery period information is information indicating a period of time required to deliver an ink bottle 31 to a place in which a printing apparatus 11 was installed.

The user information database DB associates one or more item of ink bottle identification information with one item of apparatus identification information. Ink bottle identification information is an ink-bottle-specific identification information configured to identify an ink bottle 31 configured to be used in a printing apparatus 11.

The user information database DB associates ink bottle class information, authentication information, and scheduled date of delivery with one item of ink bottle identification information. Ink bottle class information is information indicating the class of an ink bottle 31 and is also configured to identify the contained amount of ink contained in the ink bottle 31. Authentication information is information that is used in authentication between the server apparatus 200 and a printing apparatus 11 after delivery of an ink bottle 31. Scheduled date of delivery is information indicating the date of delivery of an ink bottle 31 to a place in which a printing apparatus 11 was installed. Scheduled date of delivery is calculated as a date obtained by adding, to the date and time of reception of a delivery request for an ink bottle 31, delivery period information corresponding to apparatus identification information.

In the server apparatus 200, user registration is performed before use of a printing apparatus 11. In the user registration, user identification information, apparatus identification information, apparatus type information, apparatus communication information, delivery destination information, and delivery period information are associated with one another in the user information database DB based on information transmitted from the printing apparatus 11. The delivery period information is information acquired depending on a relationship between a source of delivery and a destination of delivery.

Upon registration of delivery period information in the server apparatus 200, the control section 210 refers to the user information database DB, reads out communication destination information corresponding to apparatus identification information in association with which the delivery period information was registered, and transmits the delivery period information to a printing apparatus 11 corresponding to the communication destination information.

Meanwhile, in the printing apparatus 11, the control section 110, upon reception of the delivery period information from the server apparatus 200, updates delivery period information assigned to the storage section 120. This allows the control section 110 to read out, from the storage section 120, delivery period information updated by the server apparatus 200.

Various types of process that are performed in a printing apparatus 11 and the server apparatus 200 in accordance with various types of control program are described here. First, an authentication process that is executed in a printing apparatus 11 is described. This authentication process is executed by the control section 110 of the printing apparatus 11 upon an authentication instruction in response to an operation on the operation section 15.

Figure 9:
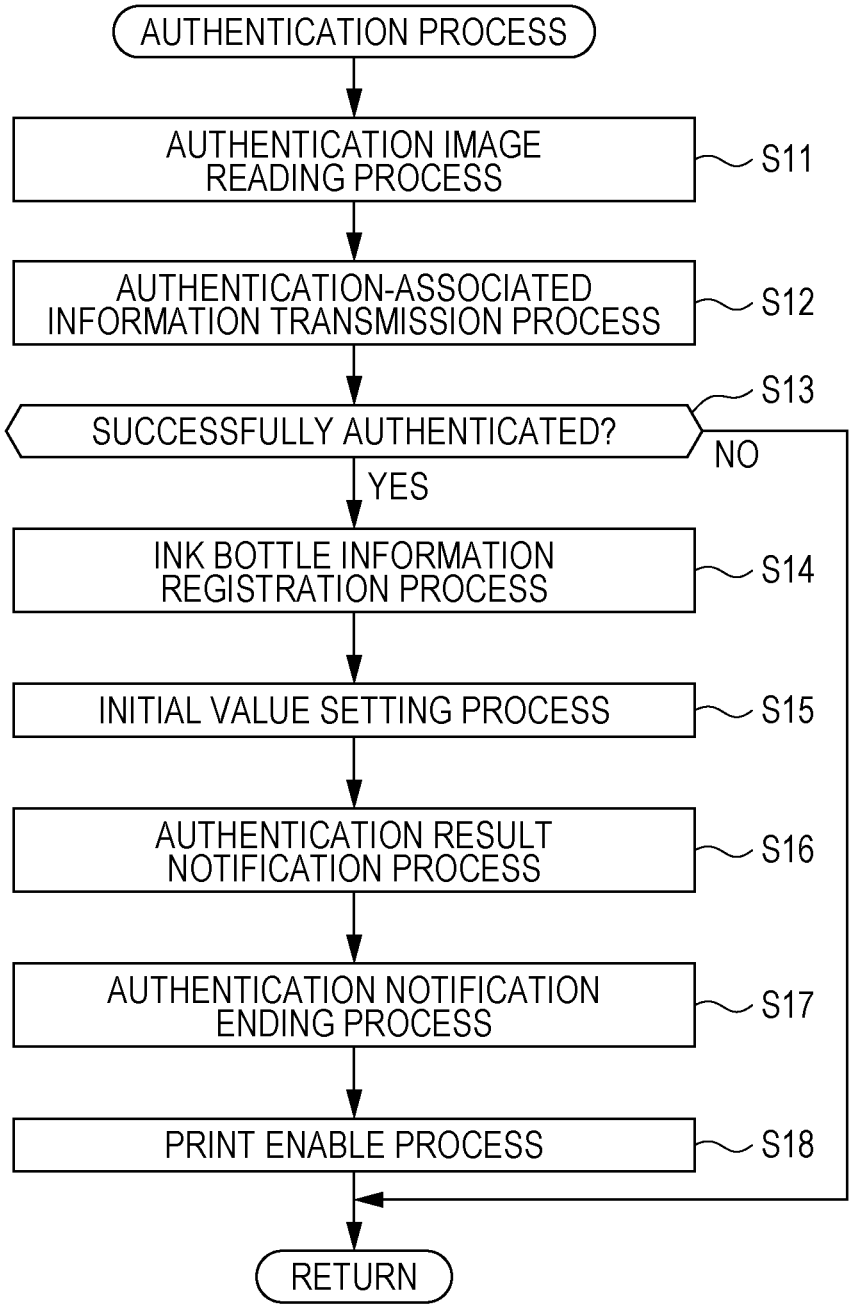
FIG. 9 is a flow chart showing an authentication process that a control section of a printing apparatus executes.

As shown FIG. 9, in step S11, the control section 110 executes an authentication image reading process of causing the image reading section 13 to read an authentication image serving as authentication information attached to an ink bottle 31 that has been delivered. In this process, the control section 110 outputs a read instruction to cause the image reading section 13 to read the authentication image and stores the image data read by the image reading section 13 as the authentication information in the storage section 120. In this way, the image reading section 13 acquires the authentication image as the authentication information attached to the ink bottle 13. The image reading section 13 is equivalent to an example of an image acquisition section. The authentication information is equivalent to an example of liquid container information, and the authentication image is equivalent to an example of a liquid container image.

Then, in step S12, the control section 110 executes an authentication-associated information transmission process of making an authentication request by transmitting authentication-associated information to the server apparatus 200 via the communication section 130 and the network NT. The authentication-associated information contains the authentication information read by the image reading section 13 and apparatus identification information specific to the printing apparatus 11.

Meanwhile, in the server apparatus 200, the control section 210, upon reception of the authentication-associated information via the network NT and the communication section 230, refers to one or more item of authentication information, included in the authentication information registered in the user information database DB, that correspond to the apparatus identification information contained in the authentication-associated information thus received. Then, the control section 210 checks whether the authentication information thus referred to and the authentication information contained in the authentication-associated information thus received match.

When the control section 210 has determined, as a result of the check, the presence of authentication information that matches the authentication information contained in the authentication-associated information thus received, the control section 210 transmits authentication result information indicating successful authentication via the communication section 230 and the network NT to the printing apparatus 11 that outputted the authentication-associated information. When the control section 210 has determined, as a result of the check, the absence of authentication information that matches the authentication information contained in the authentication-associated information thus received, the control section 210 transmits authentication result information indicating failed authentication via the communication section 230 and the network NT to the printing apparatus 11 that outputted the authentication-associated information.

In the printing apparatus 11, the control section 110 proceeds to step S13, in which the control section 110 determines, based on the authentication result information transmitted from the server apparatus 200, whether the authentication has succeeded. When the control section 110 has received the authentication result information indicating the failed authentication and determined that the authentication has failed, the control section 110 causes the display section 16 to display an authentication result indicating the failed authentication, and ends the authentication process without executing steps S14 to S18.

When the control section 110 has received the authentication result information indicating the successful authentication and determined that the authentication has succeeded, the control section 110 proceeds to step S14, in which the control section 110 executes an ink bottle information registration process. In this process, the control section 110 registers ink bottle information by accumulatively storing, in the storage section 120, ink bottle information associating the types of successfully-authenticated ink bottles 31 and authentication information with each other.

Then, in step S15, the control section 110 executes an initial value setting process. In this process, the control section 110 sets, to "0", the initial value of the ink counter assigned to the storage section 120. This ink counter is a counter that, based on image data to be printed, indicates the amount of consumption of each color of ink consumed. In this way, the control section 110 sets the initial value of the ink counter upon authentication of authentication information relating to a new ink bottle 31 that has been delivered.

Further, the control section 110 reads out, from the storage section 120, a value indicating an amount contained in an ink bottle 31 corresponding to the type of the ink bottle 31 thus delivered and adds the value to the ink bottle counter assigned to the storage section 120. This ink bottle counter is a counter that indicates the remaining amount of each color of ink contained in the ink bottle 31 thus delivered, yet to be discharged (consumed) by the discharge section 23, and estimated to be held in the ink bottle 31 and the ink accommodation body 18. In this way, upon authentication of authentication information relating to a new ink bottle 31 that has been delivered, the control section 110 adds, to the ink bottle counter, a value corresponding to the contained amount of ink contained in the ink bottle 31 and thereby sets the initial value to a counted value relating to the amount of consumption of ink with which the ink bottle 31 was contained.

Upon authentication of this ink bottle 31, the control section 110 may set, as the initial value of the ink bottle counter, a corrected value obtained by adding together the amount of ink remaining in the ink accommodation body 18 as acquired based on a detection signal from the held amount detection section 38 or an input value from the operation section 15 and the amount contained in the ink bottle 31. Such a process is executed by the counting section 111 of the control section 110.

Next, in step S16, the control section 110 executes an authentication result notification process. In this process, the control section 110 notifies the successful authentication by causing the display section 16 to display the authentication result indicating the successful authentication.

Then, in step S17, the control section 110 executes an authentication notification ending process. In this process, the control section 110 erases an image prompting authentication of the authentication information attached to the ink bottle 31, and ends the notification of authentication. In this way, upon authentication of authentication information relating to a new ink bottle 31 that has been delivered, the control section 110 ends a notification prompting authentication of the authentication information relating to the new ink bottle 31 that has been delivered. In other words, upon authentication of authentication information relating to a new ink bottle 31 that has been delivered, the display section 16 ends a notification prompting authentication of the authentication information relating to the new ink bottle 31 that has been delivered.

Then, in step S18, the control section 110 executes a print enable process and ends the authentication process. In this process, the control section 110 sets, as a print disable flag assigned to the storage section 120, a value indicating that printing is not disabled. The print disable flag is a flag for determining whether printing is disabled. In this way, after having disabled the printing section 12 for printing, the control section 110 cancels the disablement of the printing section 12 for printing upon authentication of authentication information relating to a new ink bottle 31 that has been delivered.

Next, a delivery request control process that is executed in a printing apparatus 11 is described. This delivery request control process is executed by the control section 110 of the printing apparatus 11 at every predetermined cycle.

Figure 10:
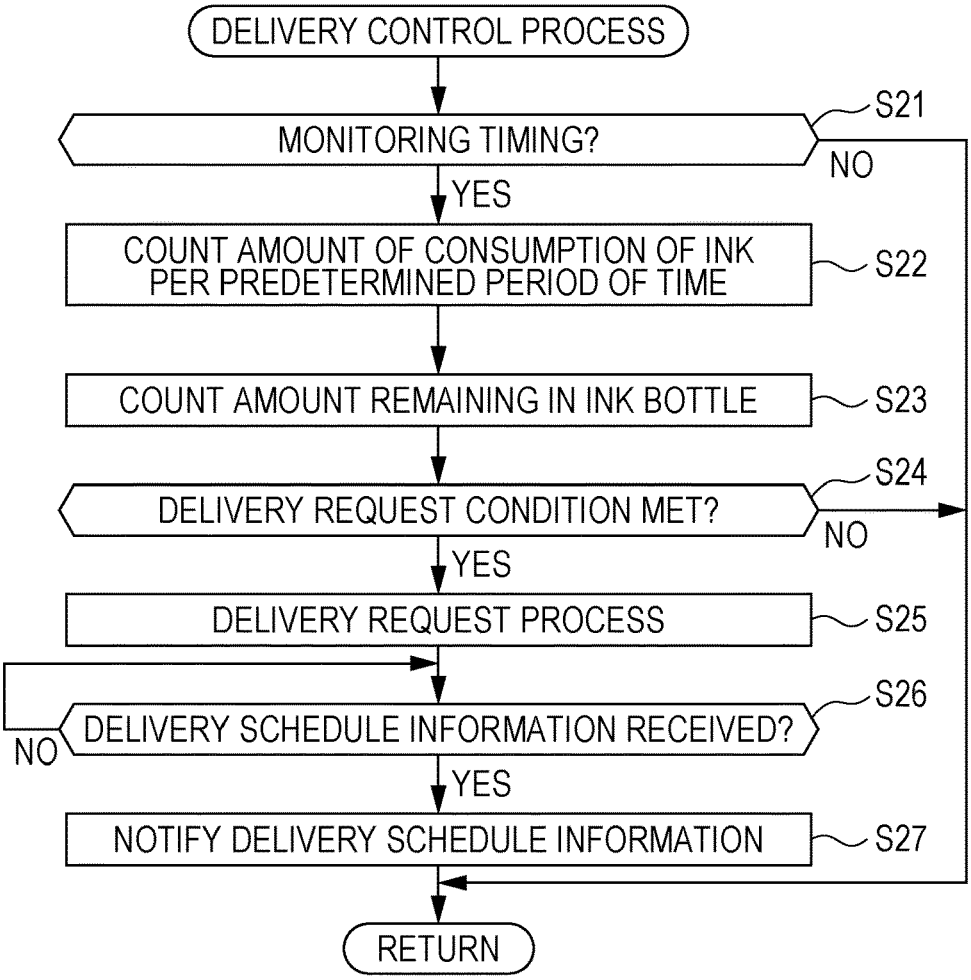
FIG. 10 is a flow chart showing a delivery request control process that the control section 110 of the printing apparatus 11 executes.

As shown in FIG. 10, in step S21, the control section 110 determines whether a monitoring timing relating to the amount of consumption of ink has come. In the present embodiment, it is preferable that the monitoring timing be a timing, such as one day, that repeatedly comes in a given period of time and a time that repeatedly comes in a shorter period than the delivery period. When the control section 110 has determined that a monitoring timing relating to the amount of consumption of ink has not come, the control section 110 ends the delivery request control process without executing steps S22 to S27.

When the control section 110 has determined that a monitoring timing relating to the amount of consumption of ink has come, the control section 110 proceeds to step S22, in which the control section 110 counts the amount of consumption of ink per predetermined period of time. In the present embodiment, the predetermined period of time is the same period of time as the delivery period of an ink bottle 31. However, this is not intended to impose any limitation. For example, the predetermined period of time may be a longer period of time than the delivery period of an ink bottle 31 or may be a shorter period of time than the delivery period of an ink bottle 31. In this process, the control section 110 stores the value of the ink counter in the storage section 120 at a monitoring timing relating to the amount of consumption of ink. Then, the control section 110 calculates the amount of consumption of ink per predetermined period of time from the difference between the value of the ink counter this time and the value of the ink counter the predetermined period of time ago out of the values of the ink counter stored in the storage section 120. Specifically, for example, when the delivery period and the predetermined period are seven days and the monitoring timing is one day, the control section 110 stores the value of the ink counter in the storage section 120 every day and counts the amount of consumption of ink per seven days, which is equivalent to the delivery period, from the value of the ink counter for the immediately preceding seven days.

Then, in step S23, the control section 110 counts an ink bottle remaining amount. In this process, the control section 110 reads a value from the ink bottle counter assigned to the storage section 120 and estimates the remaining amount of unconsumed ink out of ink with which an ink bottle 31 that has been delivered was contained. In this way, the control section 110 performs counting relating to the amount of consumption of ink with which an ink bottle 31 was contained and counting relating to the amount of consumption of ink per predetermined period of time. Such a process is executed by the counting section 111 of the control section 110.

Next, in step S24, the control section 110 determines whether a delivery request condition is met. In the present embodiment, a delivery request condition is met when, for at least any of the colors of ink, the remaining amount of ink with which an ink bottle 31 was contained has become equal to or smaller than the amount of consumption of ink per predetermined period of time. When the value of the ink bottle counter has become "0", it is an estimated timing of completion of consumption of ink with which an ink bottle 31 was contained. Further, the predetermined period of time is equivalent to the delivery period of an ink bottle 31, and the monitoring timing is defined as a sufficiently shorter period of time than the delivery time. For this reason, when the value of the ink bottle counter has become equal to the amount of consumption of ink per predetermined period of time, it is a timing that is earlier by the delivery period of an ink bottle 31 than an estimated timing of completion of consumption of ink with which an ink bottle 31 was contained. Then, at a monitoring timing, a delivery request condition is met when the remaining amount of ink with which an ink bottle 31 was contained has become equal to or smaller than the amount of consumption of ink per predetermined period of time. Specifically, for example, the control section 110 determines that a delivery request condition is met when the amount of consumption of ink per predetermined period of time, which is equivalent to the delivery period, is 5 g and the remaining amount of ink with which an ink bottle 31 was contained has become 5 g.

A delivery request timing is not limited to the time when the value of the ink bottle counter, which counts a total remaining ink amount that is the sum of the amount of ink remaining in the ink bottle 31 and the amount of ink remaining in the ink accommodation body 18, has become equal to the amount of consumption if ink per delivery period. A delivery request may be made at a timing that is earlier by the delivery period than a timing at which a value obtained by adding, to the amount of consumption of ink per delivery period, a predetermined margin of value ranging from an ink end ("0") to a near end is estimated to be reached. In this case, a new ink bottle 31 can be delivered to a user at a timing when the total amount of ink remaining in the ink bottle 31 and the ink accommodation body 18 has reached a value equivalent to a near end.

When the control section 11 has determined that a delivery request condition is not met, the control section 110 ends the delivery request control process without executing steps S25 to S27. On the other hand, when the control section 11 has determined that a delivery request condition is met, the control section 110 executes a delivery request process of sending the server apparatus 200 a delivery request for an ink bottle 31, and proceeds to step S26. In this way, based on a counting result relating to the amount of consumption of ink with which an ink bottle 31 was contained and a counting result relating to the amount of consumption of ink per predetermined period of time, the control section 110 sends the server apparatus 200 a delivery request for an ink bottle 31 by a time that is earlier by a delivery time of an ink bottle 31 than an estimated timing of completion of consumption of ink with which an ink bottle 31 was contained. Such a process is executed by the delivery request section 112 of the control section 110.

Meanwhile, in the server apparatus 200, the control section 210, upon reception of a delivery request via the network NT and the communication section 230, refers to the user information database DB and reads out apparatus class information corresponding to apparatus identification information specific to the printing apparatus 11. Then, the control section 210 chooses, as an ink bottle 31 to be delivered, a class of ink bottle 31 corresponding to the apparatus class information and suitable to the printing apparatus 11. Next, the control section 210 refers to the user information database DB, reads out delivery period information corresponding to the apparatus identification information specific to the printing apparatus 11, and chooses, as a scheduled date of delivery, a date obtained by adding, to the current date and time, the delivery period information corresponding to the apparatus identification information. Further, the control section 210 generates authentication information corresponding to the ink bottle 31 to be delivered. Then, in association with the apparatus identification information, the control section 210 registers ink bottle identification information, the type of the ink bottle 31, the authentication information, and the scheduled date of delivery as information relating to the new ink bottle 31 to be delivered. With this, the control section 210 registers, in the user information database DB, information for delivering the ink bottle 31 and then generates, based on the information thus registered, delivery information for delivering the ink bottle 31. In response to the generation of such delivery information, the ink bottle 31 is delivered. Next, the control section 210 transmits delivery schedule information indicating the scheduled date of delivery via the communication section 230 and the network NT to the printing apparatus 11 that made the delivery request. This delivery schedule information is information that is transmitted to the printing apparatus 11 as a result of the reception of the delivery request, and is also equivalent to delivery acceptance information indicating the reception of the delivery request. In this way, in the server apparatus 200, the control section 210, upon acceptance of a delivery request, acquires delivery schedule information on a new ink bottle 31 and transmits delivery schedule information indicating the acceptance of the delivery request and a delivery schedule to the printing apparatus 11. Such a control section 210 is equivalent to an example of a delivery schedule information acquisition section, a delivery acceptance information transmission section, and a delivery schedule information transmission section.

In the printing apparatus 11, the control section 110 proceeds to step S26, in which the control section 110 determines whether it has received delivery schedule information via the network NT and the communication section 130. When the control section 110 has determined that it has not received delivery schedule information, the control section 110 repeatedly executes step S26 again. When the control section 110 has determined that it has received delivery schedule information, the control section 110 proceeds to step S27, in which the control section 110 notifies the acceptance of the delivery request and the scheduled date of delivery by displaying, on the display section 16, an image indicating the acceptance of the delivery request and an image indicating the scheduled date of delivery, and ends the delivery request control process. In this way, upon reception of delivery schedule information from the server apparatus 200, the control section 110 causes the display section 16 to notify the acceptance of a delivery request and a schedule of delivery of a new liquid container. In other words, upon reception of delivery schedule information from the server apparatus 200, the display section 16 notifies the acceptance of a delivery request and a schedule of delivery of a new liquid container. Such a display section 16 is equivalent to an example of a delivery acceptance notification section and a delivery schedule notification section.

Next, a print control process that is executed in a printing apparatus 11 is described. This print control process is executed by the control section 110 of the printing apparatus 11 upon a print instruction in response to an operation on the operation section 15.

In the printing apparatus 11, the control section 110, upon a print instruction, reads out a print disable flag assigned to the storage section 120 and determines whether printing is disabled. When the control section 110 has determined that printing is disabled, the control section 110 ends the print control process. On the other hand, when the control section 110 has determined that printing is not disabled, the control section 110 controls the transport motor 27, the carriage motor 32, and the discharge section 23 based on image data contained in the print instruction and thereby executes a printing process of performing printing by discharging ink onto a sheet of paper.

Then, as a result of the execution of the printing process, the control section 110, based on the image data thus printed, adds a value indicating the amount of consumption of each color of ink consumed to the ink counter assigned to the storage section 120. The control section 110 adds, to the ink counter, a value indicating the amount of consumption of ink emitted from the discharge section 23 for maintenance of the nozzle of the discharge section 23. With this, the control section 110 counts the amount of consumption of ink consumed and adds the result thus counted to the ink counter assigned to the storage section 120, thereby making it possible to recognize the amount of consumption of ink consumed. The control section 110 stores the value of the ink counter for a predetermined period of time every predetermined time. The control section 110 calculates the difference between the amount of consumption of ink this time, which is the current value of the ink counter, and the value of the amount of consumption of ink the predetermined period of time ago and acquires the amount of consumption of ink consumed during the most recent predetermined period of time. In the present example, the predetermined period of time is set to seven days. For example, amounts of consumption of ink vary depending on the day of the week, it is preferable that the predetermined period of time be not shorter than seven days. Note, however, that the predetermined period of time may be shorter than seven days.

The control section 110 is configured to acquire an ink consumption rate by dividing, by the number of days of the predetermined period of time, the amount of consumption of ink consumed during the most recent predetermined period. The control section 110 is configured to calculate the average amount of consumption of ink per day, i.e. the ink consumption rate, for example, by dividing, by the number of day "7" for the predetermined period of time, the amount of consumption of ink consumed during the most recent predetermined period. In the present embodiment, a delivery period required to deliver an ink bottle 31 is set as the predetermined period of time. For this reason, the amount of consumption of ink consumed during the most recent predetermined period indicates an estimated value of the amount of consumption of ink that is consumed during the delivery period. When the predetermined period of time and the delivery period differ from each other, the control section 110, by multiplying the average amount of consumption of ink per day by the number of days of the delivery period (delivery time), calculates the amount of consumption of ink that is consumed during the delivery period. The method described here is an example, and it is possible to appropriately adopt any calculation method involving the use of any counting method and any counted value, provided the amount of consumption of ink per delivery period can be acquired.

Further, as a result of the execution of the printing process, the control section 110, based on the image data thus printed, subtracts a value indicating the amount of consumption of each color of ink consumed, i.e. the value of the ink counter, from the ink bottle counter assigned to the storage section 120, and ends the print control process. With this, the control section 110 counts the amount of consumption of ink consumed and subtracts the result thus counted from the ink bottle counter assigned to the storage section 120, thereby making it possible to recognize the amount of consumption (remaining amount) of ink with which an ink bottle 31 was contained. In this way, the counting section 111 of the control section 110 performs counting relating to the amount of consumption of ink with which an ink bottle 31 was contained.

Next, a remaining ink amount monitoring process that is executed in a printing apparatus 11 is described. This remaining ink amount monitoring process is executed by the control section 110 of the printing apparatus 11 at every predetermined cycle.

Figure 11:
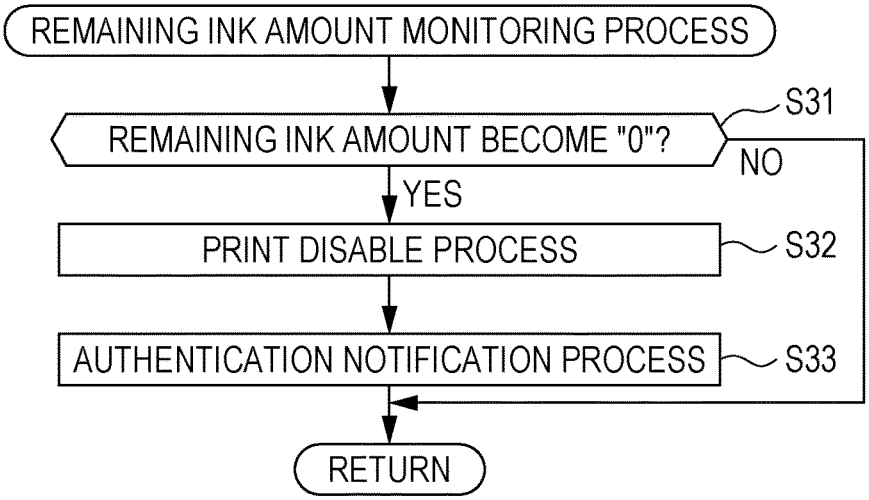
FIG. 11 is a flow chart showing an remaining ink amount monitoring process that the control section of the printing apparatus executes.

As shown in FIG. 11, in step S31, the control section 110 determines whether the value of the ink bottle counter has become "0". That is, the control section 110 determines whether the remaining amount of ink with which an ink bottle 31 was contained has become "0". In other words, the control section 110 determines whether the total amount of ink remaining in an ink bottle 31 and an ink accommodation body 18 into which ink is poured out of the ink bottle 31 has become "0", which indicates an ink end. When the control section 110 has determined that the amount remaining in the ink bottle 31 has not become "0", the control section 110 ends the remaining ink amount monitoring process without executing steps S32 and S33. On the other hand, when the control section 110 has determined that the remaining amount of ink has become "0", the control section 110 proceeds to step S32, in which the control section 110 sets, as a print disable flag assigned to the storage section 120, a value indicating that printing is disabled. In this way, the control section 110 disables the printing section 12 for printing at an estimated timing of completion of consumption of ink with which an ink bottle 31 was contained.

Then, in step S33, the control section 110 executes an authentication notification process and ends the remaining ink amount monitoring process. In this process, the control section 110, by causing the display section 16 to display an authentication image prompting authentication, makes an authentication notification prompting authentication. In this way, at an estimated timing of completion of consumption of ink with which an ink bottle 31 was contained, the control section 110 causes the display section 16 to make a notification prompting authentication of authentication information relating to a new ink bottle 31 that has been delivered. In other words, at an estimated timing of completion of consumption of ink with which an ink bottle 31 was contained, the display section 16 makes a notification prompting authentication of authentication information relating to a new ink bottle 31 that has been delivered. The display section 16, which makes such a notification, is equivalent to an example of an authentication notification section.

The workings of the printing system 10 are described. First, the workings of a case where an ink bottle 31 is coupled to an ink pouring flow passage 39 and the ink holding chamber 40 is replenished with ink held in the ink bottle 31 are described. The first ink accommodation body 18A is described as a representative of the ink accommodation bodys 18, and a description of the second ink accommodation bodys 18B is omitted.

As shown in FIGS. 5 and 6, when the ink bottle 31 is coupled to the tubular portion 73 of the ink pouring flow passage 39 at the first end 39*a*, the ink flows through the first ink flow passage 74*a* and the second ink flow passage 74*b* in such a manner as to descend toward the ink holding chamber 40. Then, air inside the ink holding chamber 40 is pressurized by being pressed by the ink.

A portion of the ink that flows through the first ink flow passage 74*a* flows into the ink holding chamber 40. Meanwhile, a portion of the ink that flows through the second ink flow passage 74*b* stops descending by being pressed by air pressure inside the ink holding chamber 40 at some midpoint in the second ink flow passage 74*b*. Then, the ink inside the second ink flow passage 74*b* is pressed back to the ink bottle 31 by the air pressure inside the ink holding chamber 40 into which ink has flowed.

For this reason, the first ink flow passage 74*a* serves as a flow passage through which ink flows from the ink bottle 31 into the ink holding chamber 40, and the second ink flow passage 74*b* serves as a flow passage through which air inside the ink holding chamber 40 flows into the ink bottle 31. That is, the ink bottle 31 and the ink accommodation body 18 carry out a so-called gas-liquid exchange by which as much air inside the ink holding chamber 40 as ink poured out of the ink bottle 31 into the ink holding chamber 40 flows into the ink bottle 31.

Moreover, when the liquid level of ink rises to the second end 39*b* and the ink closes the second end 39*b* of the second ink flow passage 74*b*, air no longer flows into the ink bottle 31 through the second ink flow passage 74*b*. This causes a reduction in pressure on the liquid level of the ink inside the ink bottle 31 and stops the inflow of ink from the ink bottle 31 into the ink holding chamber 40.

Removing the ink bottle 31 from the ink pouring flow passage 39 renders the ink inside the first ink flow passage 74*a* subject to atmospheric pressure. Therefore, the ink inside the first ink flow passage 74*a* flows into the ink holding chamber 40, so that the ink pouring flow passage 39 and the ink holding chamber 40 come to have the same liquid level of ink as each other.

Next, the workings of a case where an ink bottle 31 is delivered in the printing system 10 are described. When a printing apparatus 11 is used for the first time, printing becomes disabled with no ink held in an ink accommodation body 18, and an authentication notification prompting authentication is made.

Then, ink contained in an ink bottle 31 that has been delivered is poured into the ink accommodation body 18. Further, upon an authentication instruction, authentication information attached to the ink bottle 31 that has been delivered is read by the image reading section 13, and authentication-associated information containing the authentication information is transmitted to the server apparatus 200.

Meanwhile, upon reception of the authentication-associated information, the server apparatus 200 checks it against the authentication information registered in the user information database DB and transmits authentication result information indicating an authentication result to the printing apparatus 11.

When the printing apparatus 11 has received authentication result information indicating successful authentication and determined that the authentication has succeeded, the printing apparatus 11 sets the initial value of the ink counter to "0". A value indicating the contained amount of ink with which the ink bottle 31 was contained is added to the ink bottle counter. This causes the ink bottle counter to be set to the initial value. Thus, when the printing apparatus 11 is used for the first time, the ink accommodation body 18 is empty and a user pours ink out of the ink bottle 31 into the empty ink accommodation body 18. In this case, a portion of the ink of the ink bottle 31 is merely transferred to the ink accommodation body 18, and no ink has been consumed. For this reason, the value of the ink bottle counter indicates the total amount of ink remaining in the ink bottle 31 and the ink accommodation body 18. When the printing apparatus 11 is used for the first time, the total remaining ink amount is equal to the amount contained in the ink bottle 31. Moreover, while the successful authentication is notified, the notification prompting authentication of the authentication information relating to the new ink bottle 31 that has been delivered is ended, and printing becomes enabled.

Upon a print instruction, the printing apparatus 11 performs printing by discharging ink onto a sheet of paper based on image data contained in the print instruction. In this case, based on the image data thus printed, a value indicating the amount of consumption of each color of ink consumed is added to the ink counter. Further, when maintenance has been performed on the printing apparatus 11, a value indicating the amount of consumption of each color of ink consumed is added to the ink counter. This causes the amount of consumption of ink consumed to be counted, thereby making it possible to recognize the amount of consumption of ink consumed.

Further, the value of the ink bottle counter is updated by subtracting the difference between the previous and current values of the ink counter from the ink bottle counter. That is, the same value is subtracted from the value of the ink bottle counter as the value added to the ink counter this time. This makes it possible to recognize, from the value of the ink bottle counter, the amount of consumption (remaining amount) of ink with which the ink bottle 31 was contained.

When a monitoring timing has come, the control section 110 calculates the difference between the value of the ink counter this time and the amount of consumption of ink the predetermined period of time ago and acquires the amount of consumption of ink per predetermined period of time. When the predetermined period of time and the delivery period are the same, the amount of consumption of ink per predetermined period of time is an estimated value of the amount of consumption of ink per delivery period. When the predetermined period of time and the delivery period are different, the ink consumption rate is acquired by dividing the amount of consumption of ink per predetermined period of time by the number of days of the predetermined period of time. Then, the control section 110 acquires the estimated value of the amount of consumption of ink per delivery period by multiplying the ink consumption rate by the number of days of the delivery period.

The control section 110 calculates a determinant value that is used to make a determination as to whether a delivery request condition is met. That is, the control section 110 acquires the determinant value by adding the estimated value of the amount of consumption of ink per delivery period to the value "0", which indicates an ink end, or the predetermined margin of value. When a new ink bottle 31 needs to be delivered to a user on the very day of an ink end, the determinant value is the amount of consumption of ink per delivery period. Alternatively, when a new ink bottle 31 needs to be surely delivered to a user at an earlier timing than an ink end, the determinant value is the sum of predetermined margin of value and the predetermined margin of value. In order for a delivery request condition to be met, the amount of ink remaining in the ink bottle 31, which is the value of the ink bottle counter, needs to reach the determinant value. The control section 110, by determining whether the value of the ink bottle counter has reached the determinant value, determines whether a delivery request condition is met.

When a delivery request condition is met based on the amount of consumption (remaining amount) of ink with which the ink bottle 31 was contained and the amount of consumption of ink per predetermined period of time, the control section 110 causes the printing apparatus 11 to send the server apparatus 200 a delivery request for an ink bottle 31.

Meanwhile, upon reception of the delivery request, the server apparatus 200 refers to the user information database DB and becomes able to recognize information relating to the delivery of an ink bottle 31. Furthermore, the server apparatus 200 arranges the delivery of an ink bottle 31, adds, to a record of the user in the user information database DB, information on a scheduled date of delivery determined by a delivery arrangement process, and transmits delivery schedule information on the ink bottle 31 to the printing apparatus 11. Upon reception of the delivery schedule information, the control section 110 of the printing apparatus 11 notifies the user by displaying, on the display section 16, information to the effect that the delivery request was accepted and the scheduled date of delivery.

Further, when the value of the ink bottle counter is "0" and the remaining amount of ink with which an ink bottle 31 was contained has become "0", printing becomes disabled, and an authentication notification prompting authentication is made on the display section 16 of the printing apparatus 11.

In this case, upon delivery of a new ink bottle 31, an occurrence takes place which is similar to that took place when the printing apparatus 11 was used for the first time; that is, upon an authentication instruction, authentication information attached to the ink bottle 31 that has been delivered is read by the image reading section 13, and authentication-associated information containing the authentication information is transmitted to the server apparatus 200.

Meanwhile, upon reception of the authentication-associated information, the server apparatus 200 checks it against the authentication information registered in the user information database DB and transmits authentication result information indicating an authentication result to the printing apparatus 11.

When the printing apparatus 11 has received authentication result information indicating successful authentication and determined that the authentication has succeeded, the printing apparatus 11 sets the initial value of the ink counter to "0". A value indicating the contained amount of ink with which the newly-delivered ink bottle 31 was contained is added to the ink bottle counter. This causes the ink bottle counter to be set to the initial value. Moreover, while the successful authentication is notified, the notification prompting authentication of the authentication information relating to the new ink bottle 31 that has been delivered is ended, and printing becomes enabled.

There is a case where ink remains in the ink accommodation body 18 at the time of first use of an ink bottle 31. For example, when a new ink bottle 31 is delivered to a user at a timing when the amount of ink remaining in the printing apparatus 11 has reached a near end, a near-end worth of ink remains in the ink accommodation body 18 at the time of first use of the ink bottle 31. When the printing apparatus 11 is configured to include a held amount detection section 38, the held amount detection section 38 detects a near-end worth of remaining ink amount. Further, looking at the scale on the window portion 21 allows a user to recognize the liquid level of ink remaining in the ink accommodation body 18.

The control section 110 may set, as the initial value of the ink bottle counter, a corrected value obtained by adding, to the amount contained in the ink bottle 31, the amount of ink remaining in the ink accommodation body 18 based on a detection signal from the held amount detection section 38 or an input value from the operation section 15. By so doing, even if ink remains in the ink accommodation body 18 at the time of first use of an ink bottle 31, a delivery request for a new ink bottle 31 can be made next time at an appropriate timing that is not too early.

As described in detail above, the present embodiment makes it possible to bring about the following effects.

1. An ink accommodation body 18 into which ink contained in an ink bottle 31 is configured to be poured and a printing section 12 that performs printing by discharge of ink supplied from the ink accommodation body 18 are included. Moreover, based on a counting result relating to the amount of consumption of ink with which an ink bottle 31 was contained and a counting result relating to the amount of consumption of ink per predetermined period of time, a delivery request for an ink bottle 31 is sent to the server apparatus 200 by a time that is earlier by a delivery time of an ink bottle 31 than an estimated timing of completion of consumption of the ink with which the ink bottle 31 was contained. This makes it possible to estimate, based on a counting result relating to the amount of consumption of ink per predetermined period of time, a timing of completion of consumption of ink with which an ink bottle 31 was contained. Moreover, a delivery request for an ink bottle 31 is sent to the server apparatus 200 by a time that is earlier by a delivery time of an ink bottle 31 than the timing thus estimated. This makes it possible to deliver a new ink bottle 31 at a suitable timing so that the ink bottle 31 gets to a user by a timing of completion of consumption of ink with which an ink bottle 31 was contained.

2. Furthermore, through authentication of authentication information relating to a new ink bottle 31 that has been delivered, it is recognized that the new ink bottle 31 has been normally delivered. Accordingly, the initial value of an ink bottle counter is set to a counted value relating to the amount of consumption of ink with which the ink bottle 31 was contained. This makes it possible to increase the accuracy of counting relating to the amount of consumption of ink with which an ink bottle 31 was contained, and makes it possible to deliver a new ink bottle 31 at a suitable timing.

3. Printing becomes disabled at an estimated timing of completion of consumption of ink with which an ink bottle 31 was contained, and after printing has been disabled, printing can be performed upon authentication of authentication information relating to a new ink bottle 31 that has been delivered. This makes it possible to prevent printing from being performed at an estimated timing of completion of consumption of ink with which an ink bottle 31 was contained, and makes it possible to cancel disablement of printing upon recognition that a new ink bottle 31 has been normally delivered. For example, such a mistake in printing can be prevented that ink runs out during printing.

4. Furthermore, disabling printing at an estimated timing of completion of consumption of ink with which an ink bottle 31 was contained makes it possible to increase the accuracy of counting relating to the amount of consumption of ink with which an ink bottle 31 was contained, and makes it possible to deliver an ink bottle 31 at a suitable timing.

5. At an estimated timing of completion of consumption of ink with which an ink bottle 31 was contained, a notification prompting authentication of authentication information relating to a new ink bottle 31 that has been delivered is made, and upon authentication of authentication information relating to a new ink bottle 31 that has been delivered, a notification prompting authentication of authentication information relating to a new ink bottle 31 that has been delivered is ended. This makes allows a user to recognize authentication of liquid container information over a period of time necessary, and makes it possible to provide information highly useful to a user.

6. Furthermore, a user can be prevented, for example, from forgetting to authenticate authentication information, and the possibility of authentication of authentication information at a suitable timing by a user can be increased. Moreover, accordingly, the ink bottle counter is set to the initial value at a suitable timing. This makes it possible to increase the accuracy of counting relating to the amount of consumption of ink with which an ink bottle 31 was contained, and makes it possible to deliver an ink bottle 31 at a suitable timing.

7. Upon acceptance of a delivery request, the server apparatus 200 transmits delivery schedule information (delivery acceptance information) on the acceptance of the delivery request to the printing apparatus 11. Moreover, upon reception of delivery schedule information from the server apparatus 200, the printing apparatus 11 notifies acceptance of a delivery request. For this reason, upon acceptance of a delivery request by the server apparatus 200, the printing apparatus 11 notifies the acceptance of the delivery request. This allows a user to recognize acceptance of a delivery request, and makes it possible to provide information highly useful to a user.

8. Upon acceptance of a delivery request by the server apparatus 200, delivery schedule information on a new ink bottle 31 is acquired, and the delivery schedule information is transmitted to the printing apparatus 11. Moreover, upon reception of delivery schedule information from the server apparatus 200, the printing apparatus 11 notifies a schedule of delivery of a new ink bottle 31. For this reason, upon acceptance of a delivery request by the server apparatus 200, the printing apparatus 11 notifies a schedule of delivery of a new ink bottle 31. This allows a user to recognize a schedule of delivery of a new ink bottle 31, and makes it possible to provide information highly useful to a user.

9. The ink accommodation body 18 includes an ink holding chamber 40 in which ink is held and an ink pouring flow passage 39 through which ink contained in an ink bottle 31 is poured into the ink holding chamber 40, and the ink pouring flow passage 39 extends from a higher position than a top wall 47 of the ink holding chamber 40 and communicates with the ink holding chamber 40 in a lower position than the top wall 47 of the ink holding chamber 40. For this reason, when ink contained in an ink bottle 31 is poured into the ink holding chamber 40, the ink is poured from a higher position than the top wall 47 of the ink holding chamber 40 through the ink pouring flow passage 39 to a lower position than the top wall 47 of the ink holding chamber 40. Moreover, the ink is poured into the ink holding chamber 40, and when the ink thus poured raises the liquid level of ink held in the ink holding chamber 40 and the liquid level reaches the height of a second end 39*b* through which the ink pouring flow passage 39 communicates, the second end 39*b* through which the ink pouring flow passage 39 is linked is closed by the ink. Then, air no longer enters the ink pouring flow passage 39. For this reason, the pouring of the ink into the ink holding chamber 40 can be stopped at the height of the second end 39*b* through which the ink pouring flow passage 39 communicates.

10. Further, accordingly, when the ink contained in an ink bottle 31 is poured into the ink holding chamber 40, the ink is not held beyond the height of the second end 39*b* through which the ink pouring flow passage 39 communicates with the ink holding chamber 40, so that an upper limit can be placed on the poured amount of ink that is poured into the ink holding chamber 40.

11. Further, when the ink bottle 31 is coupled to the ink pouring flow passage 39 and ink contained in an ink bottle 31 is poured into the ink holding chamber 40, the inflow of the ink from the ink bottle 31 into the ink holding chamber 40 stops in a case in which closure of the second end 39*b* of the ink pouring flow passage 39 by the ink makes air no longer enter through the second end 39*b*. Moreover, when the ink bottle 31 is decoupled from the ink pouring flow passage 39, ink remaining in the ink pouring flow passage 39 becomes subject to atmospheric pressure and flows into the ink holding chamber 40.

12. An image reading section 13 acquires an authentication image as authentication information attached to an ink bottle 31. This allows a user to easily acquire an authentication image as authentication information and easily authenticate authentication information relating to a new ink bottle 31 that has been delivered, and makes it possible to provide information highly useful to a user.

13. Assuming that ink remains in the ink accommodation body 18 when an ink bottle 31 has been successfully authenticated, the control section 110 sets, as the initial value of the ink bottle counter, a corrected value obtained by adding, to the amount contained in the ink bottle 31, the amount of ink remaining in the ink accommodation body 18 based on a detection signal from the held amount detection section 38 or an input value from the operation section 15. For this reason, even if ink remains in the ink accommodation body 18 at the time of first use when an ink bottle 31 has been successfully authenticated, the control section 110 can make a delivery request at a timing that is earlier by a delivery period than a timing at which the total amount of ink remaining in the ink bottle 31 and the ink accommodation body 18 is estimated to reach an ink end. This makes it possible to avoid a situation where the delivery timing of a new ink bottle 31 is too early by a period of time equivalent to the remaining amount of ink that remained in the ink accommodation body 18 at the time of first use of an ink bottle 31.

It should be noted that the foregoing embodiments may be modified into the following modifications. Furthermore, a proper combination of the foregoing embodiments and the following modifications may be a further modification, and a proper combination of the following modifications may be a further modification.

In the present embodiment, for example, an authentication code attached to an ink bottle 31 may be inputted to the control section 110 in response to an operation on the operation section 15. In this way, the printing apparatus 11 may be configured to include an operation section 15 through which to input authentication information attached to an ink bottle 31. Such an operation section 15 is equivalent to an example of an information input section. Of course, the image reading section 13 according to the present embodiment is equivalent to an example of an information input section, too. This configuration allows a user to easily input authentication information and easily authenticate authentication information relating to a new ink bottle 31 that has been delivered, and makes it possible to provide information highly useful to a user.

In the present embodiment, for example, the printing system 10 may include a terminal apparatus configured to communicate with at least either the printing apparatus 11 or the server apparatus 200. In this case, any part or the whole of the communication between the printing apparatus 11 and the server apparatus 200 may be performed via the terminal apparatus. Further, for example, the terminal apparatus may include an operation section or an image reading section through which to input authentication information attached to an ink bottle 31. Such an operation section or an image reading section is equivalent to an example of an information input section. This configuration allows a user to easily input authentication information through the terminal apparatus and easily authenticate authentication information relating to a new ink bottle 31 that has been delivered, and makes it possible to provide information highly useful to a user.

In the present embodiment, for example, upon updating of delivery period information in the user information database DB of the server apparatus 200, the delivery period information may be transmitted to a printing apparatus 11. In this case, upon updating of delivery period information corresponding to apparatus identification information, the control section 210, based on the user information database DB, refers to communication destination information corresponding to the apparatus identification information and transmits the delivery period information to a printing apparatus 11 that corresponds to the communication destination information. In the printing apparatus 11, upon reception of the delivery period information from the server apparatus 200, the control section 110 updates delivery period information stored in the storage section 120. This allows the control section 110 to read out, from the storage section 120, the delivery period information updated in the server apparatus 200.

In the present embodiment, for example, information indicating a contained amount of ink contained in an ink bottle 31 to be delivered, together with delivery schedule information or contained in the delivery schedule information, may be transmitted from the server apparatus 200 to the printing apparatus 11. This makes it possible, even if the storage section 120 of the printing apparatus 11 does not have stored therein a class of ink bottle suitable to the printing apparatus 11, to recognize the contained amount of ink contained in the ink bottle 31.

In the present embodiment, the control section 110 may refer to the amount of consumption of ink per predetermined period of time more than once and estimate, based on the average amount of consumption of ink per predetermined period of time, a timing at which the remaining amount of ink with which an ink bottle 31 was contained becomes "0" or a predetermined value.

In the present embodiment, for example, a monitoring timing may come every hour, the ink counter may be referred to, and the amount of consumption of ink per predetermined period of time may be counted. In this way, the amount of consumption of ink is counted in a shorter period than the delivery period, and whether a delivery request condition is met is determined. This makes it possible to make a delivery request at a more suitable timing and deliver an ink bottle 31 at a more suitable timing. Alternatively, for example, a monitoring timing may come each time the power is turned on, the ink counter may be referred to, and the amount of consumption of ink per predetermined period of time may be counted. Alternatively, for example, a monitoring time may come for each job involving a print instruction, the ink counter may be referred to, and the amount of consumption of ink per predetermined period of time may be counted. Alternatively, the monitoring timing may be one obtained by adding, to a monitoring timing for every predetermined cycle, all or some of the time of an operation of turning on the printing apparatus 11, the end of a print job, the end of cleaning, and the time of a power-off operation.

In the present embodiment, for example, a delivery request condition may be met when the remaining amount of ink with which an ink bottle 31 was contained has become smaller than the amount of consumption of ink per predetermined period of time. Alternatively, for example, a delivery request condition may be met when the remaining amount of ink with which an ink bottle 31 was contained and the amount of consumption of ink per predetermined period of time have become equal to each other. In this way, it is preferable that a delivery request be made by a time that is earlier by the delivery period of an ink bottle 31 than an estimated timing of completion of consumption of ink with which an ink bottle 31 was contained.

In the present embodiment, for example, the ink bottle counter may be set to a value indicating the amount of consumption of ink with which an ink bottle 31 that has been delivered was contained. That is, the remaining amount of ink with which an ink bottle 31 that has been delivered was contained may be counted, or the amount of consumption of ink with which an ink bottle 31 that has been delivered was contained per se may be counted, provided counting relating to the amount of consumption of ink with which an ink bottle 31 that has been delivered was contained is performed.

In the present embodiment, for example, the control section 110 may disable printing when the remaining amount of ink held in the ink accommodation body 18 has become "0" (i.e. a so-called "ink end") based on a sensing result yielded by the held amount detection section 38. Alternatively, for example, the control section 110 may disable printing when the ink bottle counter has become "0" or when the remaining amount of ink held in the ink accommodation body 18 has become "0". Alternatively, for example, the control section 110 may disable printing when the remaining amount of ink held in the ink accommodation body 18 has become a defined amount (i.e. a so-called "near end") that approximates to "0".

In the present embodiment, for example, the control section 110 does not need to make a notification prompting authentication when the ink bottle counter has not become "0", even when the remaining amount of ink held in the ink accommodation body 18 has become "0" based on a sensing result yielded by the held amount detection section 38.

In the present embodiment, for example, a delivery request may be made based on the color of ink. Specifically, for example, a delivery request may be made separately for cyan, magenta, yellow, and black.

Destination information and information on the time it takes to deliver to the destination may be stored in the server apparatus 200, and the time it takes to deliver to each destination may be set.

Calendar information and weather patterns may be stored in the server apparatus 200, a count of the amount of consumption may be seasonally corrected. Further, a count of the amount of consumption may be made in consideration of the amount of evaporation from the liquid accommodation body. In this case, too, the amount of evaporation from the liquid accommodation body may be seasonally corrected.

In the present embodiment, for example, the printing apparatus 11 may include an environmental information sensing section that senses environmental information including at least either a temperature or a humidity, and the control section may acquire, based on a sensing result, a corrected value for estimating a timing of completion of consumption of ink contained in an ink bottle 31. In this case, the control section 110 estimates, based on the corrected value, the timing of completion of consumption of the ink contained in the ink bottle 31. Specifically, for example, when the temperature is high or when the humidity is low, the ink held in the ink accommodation body 18 easily evaporates; therefore, the control section 110 may estimate, based on a result obtained by multiplying the value of the ink bottle counter by a correction factor or subtracting the corrected value from the value of the ink bottle counter, a timing of completion of consumption ink contained in an ink bottle 31 so that the timing of completion of consumption of the ink contained in the ink bottle 31 becomes earlier. Alternatively, for example, the control section 210 of the server apparatus 200 may acquire, via the network NT, environmental information including at least either the temperature or humidity of a place of installation in which the printing apparatus 11 was installed and transmit, to the printing apparatus 11, a corrected value for estimating a timing of completion of consumption of ink contained in an ink bottle 31.

In the present embodiment, for example, when a delivery request is made, the held amount of ink, such as the liquid level of ink held in the ink accommodation body 18, may be inputted in response to an operation on the operation section 15. In this case, when a delivery request is made, the control section 110 also transmits information indicating the held amount of ink to the server apparatus 200, whereby the control section 210 of the server apparatus 200 may correct delivery schedule information so that the delivery schedule is accelerated or postponed. Alternatively, for example, when a delivery request is made, the control section 110 may cause the display section 16 to display an image prompting inputting of the amount of ink held in the ink accommodation body 18. Alternatively, in consideration of an error at the time of inputting of a value of information, such as the liquid level, that a user inputs, an order button may be always displayed on the display section 16 of the printing apparatus 11 or a display section of a host apparatus, so that an order request can be made at any time after information such as the liquid level has been inputted.

There may be a selectable mode in which one container can be continuously used approximately once or twice. Even when the control section 110 disables printing based on an estimated ink end, there is a case where ink actually remains in the ink accommodation body 18. For example, as a display at the time of an ink end, a user can perform input or make a selection as to where in the ink accommodation body 18 the liquid level is located, and the value of the ink bottle counter may be corrected accordingly so that the printing apparatus 11 can resume operations. Further, at any time during use of the printing apparatus 11, a user may input information as to where in the ink accommodation body 18 the liquid level is located.

An ink tank counter that counts the amount remaining in the ink accommodation body 18 may be provided separately from the ink bottle counter. In this case, upon authentication of an ink bottle 31, the control section 110 sets the ink tank counter to a value equivalent to the amount fully contained in the ink accommodation body 18. The control section 110, by subtracting the value of the amount of consumption of ink of the ink counter from the value of the ink tank counter, causes the ink tank counter to count the amount remaining in the ink accommodation body 18. When the value of the ink tank counter has become a value equivalent to a near end, the control section 110 may cause the display section 16 to display a display image prompting pouring of ink out of an ink bottle 31 into the ink accommodation body 18.

The amount held in the ink accommodation body 18 may be larger than the amount contained in an ink bottle 31. In this case, a plurality of ink bottles 31 may be delivered at a time for each color of ink. In this case, it is preferable that upon successful authentication of an ink bottle 31, the counting section 111 of the control section 110 set the initial value of the ink bottle counter to a value indicating a total amount contained in a plurality of ink bottles 31 forming a unit of delivery. Further, when there is an amount of ink remaining in the ink accommodation body 18 upon successful authentication of an ink bottle 31, the counting section 111 of the control section 110 may set, as the initial value of the ink bottle counter, a corrected value obtained by adding, to the total amount contained in the ink bottles 31 of the unit of delivery, the amount of ink remaining in the ink accommodation body 18 based on a detection signal from the held amount detection section 38 or an input value from the operation section 15. In this way, based on a counting result yielded by the counting section 111, an estimated timing of completion of consumption of liquid with which a liquid container was contained may be an estimated timing of completion of consumption of a total contained amount of liquid contained in a plurality of liquid containers forming a unit of delivery.

In the present embodiment, for example, the server apparatus 200 may include some of the functions of the printing apparatus 11, and the printing apparatus 11 may include some of the functions of the server apparatus 200. Specifically, for example, the printing apparatus 11 may check authentication information. In this case, upon an authentication instruction, the control section 110 outputs, to the server apparatus 200, a request to transmit authentication information, and in the server apparatus 200, the control section 210 transmits, to the printing apparatus 11, authentication information corresponding to an ink bottle 31 that has been delivered. In the printing apparatus 11, the control section 110 may acquire authentication information from an authentication image read by the image reading section 13 and check the authentication information against the authentication information transmitted from the server apparatus 200. Further, for example, the value of the ink counter may be transmitted from the printing apparatus 11 to the server apparatus 200. In this case, in the server apparatus 200, the ink tank counter may be assigned to the storage section 220, and the control section 210 may subtract the value of the ink tank counter based on the value of the ink counter and manage the remaining amount of ink with which an ink bottle 31 that has been delivered was contained.

In the present embodiment, for example, the ink pouring flow passage 39 may be configured to include one ink flow passage. Alternatively, for example, the ink pouring flow passage 39 may be configured to include three or more ink flow passages.

In the present embodiment, for example, ink can be arbitrarily selected, provided the ink can be printed onto a medium by adhering to the medium. For example, the ink includes, for example, ink obtained by dissolving, dispersing, or mixing, in a solvent, particles of a functional material composed of a solid such as a pigment or metallic particles and encompasses various types of composition such as a water-based ink, an oil-based ink, a gel ink, and a hot-melt ink.

In the present embodiment, for example, the medium may be paper, resin, metal, cloth, ceramic, rubber, a natural material (such as wood or stone), or a composite thereof. Further, the medium may be as thick as a plate, a sheet, a film, foil, or the like. Furthermore, the medium may be formed into any shape such as a rectangle or a circle. That is, the medium may take the form of a composite film of paper and resin (such as resin-impregnated paper or resin-coated paper), a composite film of resin and metal (laminate film), woven fabric, unwoven fabric, a disk, a circuit board, or the like.

In the present embodiment, for example, the printing apparatus may be an apparatus that prints an image such as a character, a picture, or a photograph by causing liquid such as ink to adhere to a medium, and may be a serial printer, a lateral printer, a line printer, a page printer, or other printers. Alternatively, the printing apparatus may be an offset printing apparatus, a textile printing apparatus, or other printing apparatuses. Further, the printing apparatus needs only have at least a print function of printing on a medium, and may be a multifunction printer that has a function in addition to the print function. Furthermore, the printing apparatus may be an apparatus that prints on not only a two-dimensional medium but also a medium having a three-dimensional curved surface.

The following describes technical ideas that are understood from the foregoing embodiments and modifications, together with effects.

A printing apparatus is a printing apparatus configured to communicate with a server apparatus. The printing apparatus includes a liquid accommodation body into which liquid contained in a liquid container is configured to be poured, a printing section that performs printing by discharge of liquid supplied from the liquid accommodation body, a counting section that performs counting relating to an amount of consumption of liquid with which a liquid container was contained and counting relating to an amount of consumption of liquid by the printing section per predetermined period of time, and a delivery request section that, based on a counting result yielded by the counting section, sends the server apparatus a delivery request for a liquid container by a time that is earlier by a delivery time of a liquid container than an estimated timing of completion of consumption of liquid with which a liquid container was contained. Upon authentication by the server apparatus of liquid container information relating to a new liquid container delivered, the counting section sets an initial value to a counted value relating to an amount of consumption of liquid with which the liquid container was contained.

According to this configuration, even when liquid contained in a liquid container is configured to be poured into the liquid accommodation body, a timing of completion of consumption of liquid with which the liquid container was contained can be estimated based on a result of counting of the amount of consumption of liquid with which the liquid container was contained and a counting result relating to the amount of consumption of liquid per predetermined period of time. Moreover, a delivery request for a liquid container is sent to the server apparatus by a time that is earlier by a delivery time of a liquid container than the timing thus estimated. This makes it possible to deliver a new liquid container by a timing of completion of consumption of liquid with which a liquid container was contained, and makes it possible to deliver a liquid container at a suitable timing. Furthermore, through authentication of liquid container information relating to a new liquid container that has been delivered, it is recognized that the new liquid container has been normally delivered. Accordingly, the initial value is set to a counted value relating to the amount of consumption of liquid with which the liquid container was contained. This makes it possible to increase the accuracy of counting relating to the amount of consumption of liquid with which a liquid container was contained, and makes it possible to deliver a liquid container at a suitable timing.

The printing apparatus may further include a control section that controls the printing section. In the printing apparatus, at an estimated timing of completion of consumption of liquid with which a liquid container was contained, the control section may disable the printing section for printing, and after the control section disables the printing section for printing, the control section may cancel disablement of the printing section for printing upon authentication by the server apparatus of liquid container information relating to a new liquid container delivered.

According to this configuration, printing becomes disabled at an estimated timing of completion of consumption of liquid with which a liquid container was contained. This makes it possible to prevent printing from being performed at an estimated timing of completion of consumption of liquid with which a liquid container was contained. Moreover, after printing has been disabled, printing can be performed upon authentication of liquid container information relating to a new liquid container that has been delivered, and upon recognition that the new liquid container has been normally delivered, disablement of printing can be canceled. Furthermore, disabling printing at an estimated timing of completion of consumption of liquid with which a liquid container was contained makes it possible to increase the accuracy of counting of the amount of consumption of liquid with which a liquid container was contained, and makes it possible to deliver a liquid container at a suitable timing.

The printing apparatus may further include an authentication notification section that, at an estimated timing of completion of consumption of liquid with which a liquid container was contained, makes a notification prompting authentication of liquid container information relating to a new liquid container delivered and that, upon authentication by the server apparatus of liquid container information relating to a new liquid container delivered, ends a notification prompting authentication of liquid container information relating to a new liquid container delivered.

According to this configuration, at an estimated timing of completion of consumption of liquid with which a liquid container was contained, a notification prompting authentication of liquid container information relating to a new liquid container that has been delivered is made. This allows a user to recognize authentication of liquid container information, and makes it possible to provide information highly useful to a user. Moreover, upon authentication of liquid container information relating to a new liquid container that has been delivered, a notification prompting authentication of liquid container information relating to a new liquid container that has been delivered is ended. This allows a user to recognize authentication of liquid container information over a period of time necessary. Furthermore, a user can be prevented, for example, from forgetting to authenticate liquid container information, and the possibility of authentication of liquid container information at a suitable timing by a user can be increased. Moreover, accordingly, the initial value is set at a suitable timing to a counted value relating to the amount of consumption of liquid with which the liquid container was contained. This makes it possible to increase the accuracy of counting relating to the amount of consumption of ink with which a liquid container was contained, and makes it possible to deliver a liquid container at a suitable timing.

In the printing apparatus, the liquid accommodation body may include a liquid holding chamber in which liquid is held and a pouring flow passage through which liquid contained in a liquid container is poured into the liquid holding chamber, and the pouring flow passage may extend from a higher position than a top wall of the liquid holding chamber and communicate with the liquid holding chamber in a lower position than the top wall of the liquid holding chamber.

According to this configuration, when liquid contained in a liquid container is poured into the liquid holding chamber, the liquid is poured from a higher position than the top wall of the liquid holding chamber through the pouring flow passage to a lower position than the top wall of the liquid holding chamber. Moreover, the liquid is poured into the liquid holding chamber, and when the liquid thus poured raises the liquid level of liquid held in the liquid holding chamber and the liquid level reaches a height at which the pouring flow passage communicates, a portion of the pouring flow passage 39 that is linked is closed by the liquid, with the result that air no longer enters the pouring flow passage. For this reason, the pouring of the liquid into the liquid holding chamber can be stopped at the height at which the pouring flow passage communicates. For this reason, when liquid contained in a liquid container is poured into the liquid holding chamber, the liquid is not held beyond the height at which the pouring flow passage communicates with the ink holding chamber, so that an upper limit can be placed on the poured amount of liquid that is poured into the ink holding chamber.

The printing apparatus may further include an information input section through which to input liquid container information attached to a liquid container.

This configuration allows a user to easily input liquid container information and easily authenticate liquid container information relating to a new liquid container that has been delivered, and makes it possible to provide information highly useful to a user.

The printing apparatus may further include an image acquisition section that acquires a liquid container image as liquid container information attached to a liquid container.

This configuration allows a user to easily acquire an authentication image as liquid container information and easily authenticate liquid container information relating to a new liquid container that has been delivered, and makes it possible to provide information highly useful to a user.

A printing system is a printing system including a printing apparatus and a server apparatus configured to communicate with the printing apparatus. The printing apparatus includes a liquid accommodation body into which liquid contained in a liquid container is configured to be poured, a printing section that performs printing by discharge of liquid supplied from the liquid accommodation body, a counting section that performs counting relating to an amount of consumption of liquid with which a liquid container was contained and counting relating to an amount of consumption of liquid by the printing section per predetermined period of time, and a delivery request section that, based on a counting result yielded by the counting section, sends the server apparatus a delivery request for a liquid container by a time that is earlier by a delivery time of a liquid container than an estimated timing of completion of consumption of liquid with which a liquid container was contained. Upon authentication by the server apparatus of liquid container information relating to a new liquid container delivered, the counting section sets an initial value to a counted value relating to an amount of consumption of liquid with which the liquid container was contained. This printing system brings about the same effects as those of the aforementioned printing apparatus.

In the printing system, the printing apparatus may further include a control section that controls the printing section, and at an estimated timing of completion of consumption of liquid with which a liquid container was contained, the control section may disable the printing section for printing, and after the control section disables the printing section for printing, the control section may cancel disablement of the printing section for printing upon authentication by the server apparatus of liquid container information relating to a new liquid container delivered. This printing system brings about the same effects as those of the aforementioned printing apparatus.

In the printing system, the printing apparatus may further include an authentication notification section that, at an estimated timing of completion of consumption of liquid with which a liquid container was contained, makes a notification prompting authentication of liquid container information relating to a new liquid container delivered and that, upon authentication by the server apparatus of liquid container information relating to a new liquid container delivered, ends a notification prompting authentication of liquid container information relating to a new liquid container delivered. This printing system brings about the same effects as those of the aforementioned printing apparatus.

In the printing system, the server apparatus may include a delivery acceptance information transmission section that, upon acceptance of a delivery request from the delivery request section, transmits delivery acceptance information on the acceptance of the delivery information to the printing apparatus, and the printing apparatus may include a delivery acceptance notification section that, upon reception of delivery acceptance information from the server apparatus, notifies acceptance of a delivery request.

According to this configuration, upon acceptance of a delivery request by the server apparatus, the printing apparatus notifies the acceptance of the delivery request. This allows a user to recognize acceptance of a delivery request, and makes it possible to provide information highly useful to a user.

In the printing system, the server apparatus may include a delivery schedule information acquisition section that, upon acceptance of a delivery request from the delivery request section, acquires delivery schedule information on a new liquid container and a delivery schedule information transmission section that transmits delivery schedule information acquired by the delivery schedule information acquisition section to the printing apparatus, and the printing apparatus may include a delivery schedule notification section that, upon reception of delivery schedule information from the server apparatus, notifies a schedule of delivery of a new liquid container.

According to this configuration, upon acceptance of a delivery request by the server apparatus, the printing apparatus notifies a schedule of delivery of a new liquid container. This allows a user to recognize a schedule of delivery of a new liquid container, and makes it possible to provide information highly useful to a user.

In the printing system, the liquid accommodation body may include a liquid holding chamber in which liquid is held and a pouring flow passage through which liquid contained in a liquid container is poured into the liquid holding chamber, and the pouring flow passage may extend from a higher position than a top wall of the liquid holding chamber and communicate with the liquid holding chamber in a lower position than the top wall of the liquid holding chamber. This printing system brings about the same effects as those of the aforementioned printing apparatus.

In the printing system, the printing apparatus may further include an information input section through which to input liquid container information attached to a liquid container. This printing system brings about the same effects as those of the aforementioned printing apparatus.

The printing system may further include a terminal apparatus configured to communicate with the printing apparatus. In the printing system, the terminal apparatus may include an information input section through which to input liquid container information attached to a liquid container.

This configuration allows a user to easily input liquid container information through the terminal apparatus and easily authenticate liquid container information relating to a new liquid container that has been delivered.

In the printing system, the printing apparatus may further include an image acquisition section that acquires a liquid container image as liquid container information attached to a liquid container. This printing system brings about the same effects as those of the aforementioned printing apparatus.

What is claimed is:

1. A printing apparatus configured to communicate with a server apparatus, the printing apparatus comprising:

a liquid accommodation body into which liquid contained in a liquid container is configured to be poured;

a printing section that performs printing by discharge of the liquid supplied from the liquid accommodation body;

a counting section that performs counting relating to an amount of consumption of the liquid with which the liquid container was contained and counting relating to an amount of consumption of the liquid by the printing section per predetermined period of time; and a delivery request section that, based on a counting result yielded by the counting section, sends the server apparatus a delivery request for a liquid container by a time that is earlier only a delivery time of a liquid container than an estimated timing of completion of consumption of the liquid with which the liquid container was contained, wherein upon authentication by the server apparatus of liquid container information relating to a new liquid container delivered, the counting section sets an initial value to a counted value relating to the amount of consumption of the liquid with which the liquid container was contained.

2. The printing apparatus according to claim 1, further comprising a control section that controls the printing section, wherein at the estimated timing of completion of consumption of liquid with which the liquid container was contained, the control section disables the printing section for the printing, and after the control section disables the printing section for the printing, the control section cancels disablement of the printing section for the printing upon authentication by the server apparatus of the liquid container information relating to the new liquid container delivered.

3. The printing apparatus according to claim 1, further comprising an authentication notification section that, at the estimated timing of completion of consumption of liquid with which the liquid container was contained, makes a notification prompting authentication of the liquid container information relating to the new liquid container delivered and that, upon authentication by the server apparatus of liquid container information relating to the new liquid container delivered, ends the notification prompting authentication of the liquid container information relating to the new liquid container delivered.

4. The printing apparatus according to claim 1, wherein the liquid accommodation body includes a liquid accommodating chamber in which the liquid is held, and a pouring flow passage through which the liquid contained in a liquid container is poured into the liquid accommodating chamber, and the pouring flow passage extends from a higher position than a top wall of the liquid accommodating chamber and communicates with the liquid accommodating chamber in a lower position than the top wall of the liquid accommodating chamber.

5. The printing apparatus according to claim 1, further comprising an information input section through which to input liquid container information attached to the liquid container.

6. The printing apparatus according to claim 1, further comprising an image acquisition section that acquires a liquid container image as liquid container information attached to the liquid container.

7. A printing system comprising:

a printing apparatus; and a server apparatus configured to communicate with the printing apparatus, wherein the printing apparatus includes a liquid accommodation body into which liquid contained in a liquid container is configured to be poured, a printing section that performs printing by discharge of the liquid supplied from the liquid accommodation body, a counting section that performs counting relating to an amount of consumption of the liquid with which the liquid container was contained and counting relating to an amount of consumption of the liquid by the printing section per predetermined period of time, and a delivery request section that, based on a counting result yielded by the counting section, sends the server apparatus a delivery request for a liquid container by a time that is earlier only a delivery time of a liquid container than an estimated timing of completion of consumption of the liquid with which the liquid container was contained, and upon authentication by the server apparatus of liquid container information relating to a new liquid container delivered, the counting section sets an initial value to a counted value relating to the amount of consumption of the liquid with which the liquid container was contained.

8. The printing system according to claim 7, wherein the printing apparatus further includes a control section that controls the printing section, and at the estimated timing of completion of consumption of the liquid with which the liquid container was contained, the control section disables the printing section for the printing, and after the control section disables the printing section for the printing, the control section cancels disablement of the printing section for the printing upon authentication by the server apparatus of the liquid container information relating to the new liquid container delivered.

9. The printing system according to claim 7, wherein the printing apparatus further includes an authentication notification section that, at the estimated timing of completion of consumption of the liquid with which the liquid container was contained, makes a notification prompting authentication of the liquid container information relating to the new liquid container delivered and that, upon authentication by the server apparatus of liquid container information relating to the new liquid container delivered, ends the notification prompting authentication of the liquid container information relating to the new liquid container delivered.

10. The printing system according to claim 7, wherein the server apparatus includes a delivery acceptance information transmission section that, upon acceptance of the delivery request from the delivery request section, transmits delivery acceptance information on the acceptance of delivery information to the printing apparatus, and the printing apparatus includes a delivery acceptance notification section that, upon reception of delivery acceptance information from the server apparatus, notifies acceptance of the delivery request.

11. The printing system according to claim 7, wherein the server apparatus includes a delivery schedule information acquisition section that, upon acceptance of the delivery request from the delivery request section, acquires delivery schedule information on the new liquid container, and a delivery schedule information transmission section that transmits the delivery schedule information acquired by the delivery schedule information acquisition section to the printing apparatus, and the printing apparatus includes a delivery schedule notification section that, upon reception of the delivery schedule information from the server apparatus, notifies a schedule of delivery of a new liquid container.

12. The printing system according to claim 7, wherein the liquid accommodation body includes a liquid accommodating chamber in which the liquid is held, and a pouring flow passage through which the liquid contained in a liquid container is poured into the liquid accommodating chamber, and the pouring flow passage extends from a higher position than a top wall of the liquid accommodating chamber and communicates with the liquid accommodating chamber in a lower position than the top wall of the liquid accommodating chamber.

13. The printing system according to claim 7, wherein the printing apparatus further includes an information input section through which to input liquid container information attached to the liquid container.

14. The printing system according to claim 7, further comprising a terminal apparatus configured to communicate with the printing apparatus, wherein the terminal apparatus includes an information input section through which to input liquid container information attached to the liquid container.

15. The printing system according to claim 7, wherein the printing apparatus further includes an image acquisition section that acquires a liquid container image as the liquid container information attached to the liquid container.

* * * * *